US009011172B2

(12) United States Patent
Weber et al.

(10) Patent No.: US 9,011,172 B2
(45) Date of Patent: Apr. 21, 2015

(54) RETENTION MECHANISM DEVICE

(71) Applicant: Apple Computer Inc., Cupertino, CA (US)

(72) Inventors: Douglas J. Weber, Arcadia, CA (US); Naoto Matsuyuki, Nagoya (JP); Jason S. Sloey, Cedar Park, TX (US); Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 94 days.

(21) Appl. No.: 13/675,909

(22) Filed: Nov. 13, 2012

(65) Prior Publication Data

US 2013/0210261 A1 Aug. 15, 2013

Related U.S. Application Data

(60) Provisional application No. 61/597,705, filed on Feb. 10, 2012, provisional application No. 61/602,057, filed on Feb. 22, 2012, provisional application No. 61/693,228, filed on Aug. 24, 2012.

(51) Int. Cl.

| | |
|---|---|
| ***H01R 13/627*** | (2006.01) |
| ***H01R 13/62*** | (2006.01) |
| ***H01R 43/26*** | (2006.01) |
| *H01R 24/62* | (2011.01) |

(52) U.S. Cl.

CPC ..... *H01R 13/62* (2013.01); *H01R 13/627* (2013.01); *H01R 13/6275* (2013.01); *H01R 43/26* (2013.01); *H01R 24/62* (2013.01); *H01R 2201/06* (2013.01)

(58) Field of Classification Search

USPC ..... 439/353, 357–358, 876, 886–887

See application file for complete search history.

(56) References Cited

U.S. PATENT DOCUMENTS

| | | | | |
|---|---|---|---|---|
| 6,149,451 | A * | 11/2000 | Weber | 439/358 |
| 6,346,157 | B1 | 2/2002 | Takezawa et al. | |
| 6,406,320 | B1 | 6/2002 | Wu | |
| 7,033,218 | B2 | 4/2006 | Huang et al. | |
| 7,223,113 | B2 | 5/2007 | Nakamura | |

(Continued)

OTHER PUBLICATIONS

Non-Final Office Action mailed on Jan. 29, 2014 for U.S. Appl. No. 13/607,600, 7 pages.

(Continued)

*Primary Examiner* — Jean F Duverne

(74) *Attorney, Agent, or Firm* — Kilpatrick Townsend & Stockton LLP

(57) ABSTRACT

An improved retention mechanism having corresponding retention features is provided herein. The mechanism may include a pair of spring arm retention features in a connector receptacle engageable with a corresponding pair of recessed retention features in a connector tab and backup spring members for reducing stress within the spring arms during insertion of the tab and/or lubricating members for lubricating the retention mechanism. The backup spring is positioned adjacent an outer-facing surface or extends laterally outward from the spring arms so that deflection of the spring arms displaces the backup spring reducing stresses within each arm and/or increasing the retention force on the connector tab. The backup spring may include any or all of a bent portion of an bracket or arm, a wire, a loop, a complementary spring arm, dual backup springs, elastomeric members, compression springs and lubricating members. Methods of use and assembly such retention mechanisms are also provided.

36 Claims, 35 Drawing Sheets

(56) References Cited

U.S. PATENT DOCUMENTS

| | | | | |
|---|---|---|---|---|
| 7,445,486 | B2 * | 11/2008 | Shen et al. | 439/353 |
| 8,297,603 | B2 | 10/2012 | Imaizumi et al. | |
| 8,308,150 | B2 | 11/2012 | Tange et al. | |
| 8,485,839 | B2 * | 7/2013 | Morgan et al. | 439/353 |
| 8,533,954 | B2 | 9/2013 | Tange et al. | |
| 8,607,605 | B2 | 12/2013 | Tange et al. | |
| 8,882,529 | B2 * | 11/2014 | Weber et al. | 439/358 |
| 2007/0054536 | A1 * | 3/2007 | Nakamura | 439/353 |
| 2009/0133785 | A1 | 5/2009 | Ayada et al. | |
| 2013/0244472 | A1 | 9/2013 | Weber et al. | |
| 2014/0057479 | A1 | 2/2014 | Weber et al. | |

OTHER PUBLICATIONS

Non-Final Office Action mailed on Jun. 17, 2014 for U.S. Appl. No. 13/607,497, 14 pages.

Notice of Allowance mailed on Jun. 11, 2014 for U.S. Appl. No. 13/607,600, 9 pages.

* cited by examiner

Linear analysis
• Load [N]: 8.8
• Maximum stress [N/mm$^2$]:1318

RETENTION MECHANISM DEVICE

CROSS-REFERENCES TO RELATED APPLICATIONS

The present application is a non-provisional of and claims the benefit of U.S. Provisional Patent Application No. 61/597,705, filed Feb. 10, 2012; U.S. Provisional Patent Application No. 61/602,057, filed Feb. 22, 2012; and U.S. Provisional Patent Application No. 61/693,228, filed Aug. 24, 2012, each of which the entire contents are incorporated herein by reference.

BACKGROUND OF THE INVENTION

The present invention relates generally to retention mechanisms, and in particular retention mechanisms for use in electrical connectors.

Many devices include electrical connectors to facilitate communication between devices and/or recharging of the device by electrically coupling the device to an external power source. In a typical electrical connector system an electrical connection can be made between a plug connector and a corresponding receptacle connector by inserting the plug connector into the corresponding receptacle connector. Generally, the plug connector includes a group of electrical contacts that engage and electrically couple with corresponding electrical contacts within the receptacle connector when connected. To establish contact between corresponding contacts, an electrical connector is generally designed so that the contact carrying portion of the plug connector is fittingly received within the receptacle so as to provide a normal force on the plug connector to help maintain adequate electrical contact between the components as well as to hold the connector plug in place. In many conventional connector designs, the normal force is limited by the tightness of the fit, which often degrades over time as the connector is subjected to many cycles of use. Despite such designs, in many connector devices, the electrical plug can inadvertently become misaligned, partially withdrawn, or removed from the receptacle entirely. Additionally, many conventional designs provide little or no indication as to when the plug connector is properly positioned within the receptacle so that a user may unknowingly insert the plug connector in such a manner that the electrical contacts are not fully engaged and do not properly function.

In addition, to ensure proper contact is maintained between corresponding contacts, an electrical connector typically includes interfacing features or retaining features that interface or engage to retain the connector plug within the receptacle connector. In some instances these interfacing surfaces or features are lubricated to facilitate insertion and removal of the connector plug. After many cycles of use, however, the lubrication may be worn away such that the connector returns to a non-lubricated state. The increased friction or wear and tear on interfacing surfaces in a non-lubricated state may degrade the ability to easily insert and remove the connector plug from the receptacle as well as the integrity of the connection when electrically coupled.

BRIEF SUMMARY OF THE INVENTION

Various embodiments of the invention pertain to retention mechanisms, such as may be used in electrical connectors, that improve upon some or all of the above described deficiencies. Other embodiments of the invention pertain to methods of manufacturing such electronic connectors as well as electronic devices that include such connectors.

In view of the shortcomings in currently available electronic connectors described above, embodiments of the invention relate to connectors having improved retention forces between an electrical tab and a connector receptacle, an increased normal force between the electrical contacts of the electrical tab and the receptacle, improved ease of use by providing a more consistent feel when a tab is inserted and extracted from its corresponding receptacle, and an increased life span of the device over many cycles of use. Although many aspects and features of the invention are described in relation to the electrical connectors depicted in the accompanying figures, it is appreciated that these features and aspects can be used in a variety of different applications and connector devices. Many other commonly used data connectors include standard USB and mini USB connectors, FireWire connectors, as well as many of the proprietary connectors used with common portable electronics.

In one aspect, the invention pertains to a retention latch mechanism for use in an electrical connector device having an electrical tab and a corresponding receptacle. Typically, in such connectors, electrical contacts are formed on at least one surface of the tab and arranged in a symmetrical layout so that the contacts align with contacts of the connector receptacle. When the tab is fully inserted into the receptacle in a mated configuration, the individual contacts on the connector plug are electrically coupled to the corresponding electrical contacts of the receptacle.

In one aspect, an electrical connector includes a retention latch mechanism having corresponding retention features, for example, a connector receptacle having first and second retention features adapted to engage with corresponding third and fourth retention features on the outer surface of the insertable connector tab. In some embodiments, the retention latch mechanism comprises corresponding pairs of retention features, the retention features including a pair of spring arms, and one or more backup springs adjacent at least one of the pair of spring arms that act as a stress reducing member. The backup springs may be defined by various components and formed according to various methods, such as any of those described herein.

In some embodiments, the retention latch mechanism comprises an insertable tab having a pair of recessed retention features corresponding to a pair of spring arms that deflect laterally outward so as to be resiliently received within the recessed retention features so as to retain the insertable tab within the receptacle in a mated configuration. The mechanism may include one or more backup springs positioned adjacent one or both of the spring arms along a surface facing away from the insertion axis along which the tab is inserted into the receptacle. The backup spring may be configured and positioned so that outward lateral deflection of the one or more spring arms as the tab is inserted into the receptacle deflects the backup spring so that the backup spring exerts a force against the spring arm to counter the force applied by the insertable tab.

In another aspect, the backup spring may include a portion of one or more brackets used to couple a receptacle housing to a device, or may include additional components coupled within the receptacle so as to provide stress reduction within the retention features therein. In some embodiments, the backup spring includes a bent portion of one or more brackets, a wire, a loop, a bent arm portion, a complementary spring arm, an elastomeric member, a cylindrical member, a lubricating member, a compression spring, an outwardly curved portion of the spring arm, or any combination thereof.

Although the backup springs may be defined by a variety of different features and formed in different ways, the various embodiments described herein, utilize similar principles to provide various improvements to the retention mechanism, as described herein.

In some embodiments, the backup spring includes one or more elastomeric members, often cylindrical elastomeric members, that may be positionable adjacent the retention features through one or more corresponding holes in a housing defining the connector receptacle. The mechanism may include a plurality of elastomeric members having differing spring constants such that the elastomeric members may be interchanged so as to adjust a retention force of the assembly. In some embodiments, the backup spring includes a dual backup spring defining a pair of backup spring arms that extend alongside a pair of retention spring arms so as to distribute and reduce the stresses within the retention spring arms. The dual back springs may be formed integrally with the retaining spring arms so as to further reduce the stresses within and improve the fatigue life of the retention mechanism.

In some embodiments, the connector includes a lubricating member that allows for self-lubrication of a retention mechanism that provides retention forces between an electrical connector plug and a connector receptacle. The lubricating member lubricates interfacing surfaces of the retention mechanism thereby ensuring that the retention mechanism operates properly, providing more consistent insertion and retention forces, and increasing the life span of the device over many cycles of use. Although many aspects and features of the invention are described in relation to the electrical connectors depicted in the accompanying figures, it is appreciated that these features can be used in a variety of different applications and connector devices. The invention is not limited to any particular type of connector and may be beneficial for a variety of commonly used data connectors as well as various proprietary connectors used in common portable electronics or other devices.

In some embodiments, the retention latch mechanism comprises corresponding pairs of retention features, the retention features including one or more spring arms, and/or one or more lubricating members adjacent the one or more spring arms that provide lubrication over the lifetime of the device. The lubricating members are configured to release lubricant on a surface of one or both of the retention features during insertion or retraction of the connector plug in the receptacle to lubricate a sliding interface between the retention features during insertion/retraction of the connector plug and receptacle. Any of the lubricating members described herein may also act as stress reducing members, such as a backup spring that contacts the one or more spring arms during insertion or retraction to reduce stress therein.

In one aspect, the retention latch mechanism comprises an insertable tab of a connector plug having a pair of recessed retention features corresponding to a pair of spring arms that deflect laterally outward during insertion to be resiliently received within the recessed retention features, thereby retaining the insertable connector plug within the receptacle in a mated configuration. The mechanism further includes one or more lubricating members that may be positioned adjacent one or both of the spring arms along a surface facing away from the insertion axis along which the connector tab is inserted into the receptacle. The lubricating member is configured and positioned so that outward lateral deflection of the one or more spring arms as the connector plug is inserted into the receptacle contacts the lubricating member so that the lubricating member releases a lubricant on surface of the spring arm to maintain a lubricated state and facilitate sliding of a retention feature of the spring arm against a corresponding retention feature of the connector tab.

The lubricant may be released from the lubricating member upon contact with the lubricating member or as pressure is applied against the lubricating member by deflection of the spring arm. The lubricating member may comprise a porous material having pores, channels, and/or an internal well containing lubricant for release through the pores or channels. Any lubricant suitable for the desired application may be used. In some embodiments, release of the lubricant onto the retention feature will travel, such as along the surface, to the sliding interface between retention features, although the spring arm retention features may include a hole or groove to facilitate flow or transfer of the lubricant to the interface, such as through capillary action. In some embodiments, since the corresponding retention features are metal while various other components may include polymer or plastics, the lubricant may include any of a variety of lubricants, including but not limited to: silicone, molybdenum grease, Teflon, barium, lithium, petroleum, and graphite. The lubricant may be in a variety of forms, such as a liquid, paste, solid, powder, or any form suitable for slow-release from the lubricating member.

In an example embodiment, the lubricating member includes one or more elastomeric members adjacent the sliding interface of the retention features, often cylindrical elastomeric members so that the member can act as a backup spring. The lubricating members may be positionable through holes in a housing defining the connector receptacle so that the lubricating member can be easily assembled or so that the members can be replaced as needed as lubricant is exhausted. Alternatively, a lubricating member could be refilled through an access orifice at top of the member that can be accessed through the holes in the receptacle housing. In some embodiments, the lubricating member also acts as a backup spring, such as an elastomeric cylindrical member, to reduce the stresses in the spring arm as the arm is outwardly deflected during insertion/retraction.

In some embodiments, the backup springs may be attached to the spring arms and extend laterally outward away from the insertion axis along which the connector tab is inserted into the receptacle to provide so that contact of the backup spring against an adjacent receptacle housing component displaces the backup spring to exert a spring force on the retention spring arms directed towards the insertion axis. In some embodiments, the backup springs are configured to deflect during insertion and retraction so as to reduce stresses within the resilient spring arms, while in other embodiments, the backup springs are further configured to deflect when the connector tab is mated within the receptacle, to provide an increased normal force on the connector tab, thereby providing increased retention forces on the connector tab in the mated configuration.

In one aspect, each of the retention spring arms includes a retaining portion that extends inwardly towards the insertion axis to define a primary contact surface (e.g. a first contact surface) and includes an attached backup spring that extends laterally outward away from the insertion axis to define a secondary contact surface (e.g. second contact surface). In some embodiments, the first contact surface faces in the opposite direction as the second contact surface such that displacement of the backup spring from contact between the receptacle housing component exerts a force on the spring arm opposing the force exerted by the connector tab against the primary contact surface of the spring arm, thereby reducing the stress within the spring arm. In some embodiments, the spring rate of the secondary contact is equal to or greater than the spring rate of the primary contact surface. The backup spring may be mechanically attached or mounted to the spring arm or may be integral with the retention spring arm and formed by bending a portion laterally outward, such as by stamping, to define the backup spring with secondary contact surface. In some embodiments, the backup spring is formed adjacent the retaining portion so that the receptacle housing component contacts the second contact surface when the spring arms are deflecting laterally outward, although it is appreciated that the backup spring may be formed or attached at various other locations, such as directly opposite the primary contact surface or near the mid-point of the associated spring arms. In some embodiments, the backup springs are disposed near the retaining portion to center the connector and balance the forces within the spring arms.

In another aspect, the backup springs are compression springs that are formed separately from the spring arms and attached or mounted to the respective spring arms. Similar to those described above, the backup springs provide a secondary contact surface opposite a first contact surface so that a spring force provided by the backup spring opposes that the forces applied to the spring arm through the retaining portion by the connector tab. The compression springs extend laterally outward away from the insertion axis so that outward deflection of the spring arms during insertion of the connector tab into the receptacle compresses each backup spring to exert a force on the spring arm directed towards the insertion axis. As described above, this spring force may be used to reduce the stress within the spring arms during insertion and retraction of the connector tab into the receptacle, as well as to increase the normal force on the connector (e.g. the force of the spring arm retention feature against the retention feature of the tab) in a mated configuration. Advantageously, the compression spring allows for "tuning" of the normal force and/or stress reduction of the connector without changing the geometry of the connector components or spring arms. Thus, a connector of a particular configuration can provide a variety of differing normal forces and range of stresses within associated retention spring arms by selection of one or more compression backup springs having the desired characteristics.

In one aspect, the backup compression springs includes one or more elastomeric members, such as a series of cylindrical or circular shaped elastomeric members, that are compressible along a laterally extending axis substantially perpendicular to the insertion axis. In some embodiments, the backup compression spring includes a plurality of interconnected elastomeric circular disc-shaped members that move toward each other when the backup spring is compressed. The elastomeric disc-shaped members may be interconnected through a central portion of each by one or more inter-connected members so as to be compressible along the lateral axis. When compressed by lateral outward displacement of the spring arms, the displaced elastomeric members exert a reaction force on the spring arm in the opposite direction towards the insertion axis. The spring force of the compression backup spring may be "tuned" by increasing or decreasing the number of disc-shaped elastomeric members, selection of elastomeric members having the desired properties, and/or by changing the number of elastomeric members within the compression spring. The backup compression springs may be insert molded such that the multiple elastomeric members are included within a single elastomeric piece, such as by injection molding thermoplastic, or the backup springs may include separately attached members. In some embodiments, the backup compression springs are attached to the spring arms by insert molding the backup compression springs directly on the respective spring arms.

Methods of providing retention of a tab within a receptacle are also provided. An example method for retaining a tab within a receptacle in an electrical connector assembly includes: inserting a connector tab into the receptacle so as to contact an inward facing surface of each of a pair of spring arm retention features disposed within the receptacle; advancing the connector tab so as to displace each resilient arm laterally outward from an insertion axis along which the connector tab is inserted; contacting an outward facing surface of each arm with a corresponding backup spring member disposed within the receptacle; exerting an opposing force with the backup compression spring member so as to reduce the stress within the arms; and mating the connector tab within the receptacle by advancing the connector tab until the spring arm retention features are resiliently received within corresponding recessed retaining features of the connector tab. The backup spring may be configured as a compression spring member that compresses when the connector tab is fully mated within the receptacle so as to provide an increased normal force on the tab to improve retention of the tab within the receptacle or provide a desired insertion/retraction force profile. Methods may further include: selecting a backup spring having a spring force and geometry corresponding to a desired insertion/retraction, normal or retention force and positioning the backup compression springs within the receptacle so that lateral outward deflection of the spring arms deflects the backup springs so as to provide the desired normal force, retention force, or insertion/retraction forces on the connector. Methods may further include forming the backup springs by bending a portion of each spring arm away from the insertion axis, such as by stamping or various metal working methods, to form a second contact surface facing in a direction away from the insertion axis opposite that of the first contact surface on the retaining portion of the respective spring arm.

In another aspect, an example method includes: inserting a connector tab into the receptacle so as to contact a first contact surface on a retaining portion of each of a pair of spring arms disposed within the receptacle; advancing the connector tab so as to displace each resilient arm laterally outward from an insertion axis along which the connector tab is inserted to contact a receptacle housing component with a second contact surface on a backup spring of each spring arm, the second contact surface facing in an opposite direction as the first contact surface; exerting a spring force on the spring arm towards the insertion axis by deflecting the backup compression spring to reduce the stress within the spring arm; and mating the connector tab within the receptacle by advancing the connector tab until the spring arm retention features are resiliently received within corresponding recessed retaining features of the connector tab. Some methods include: providing an additional retention force by deflecting the backup spring through contact with the second contact surface with the receptacle housing component when the retention features are engaged in the mated configuration, thereby increasing the overall normal force exerted on the connector tab and the associated retention force of the connector. Methods may also include forming the backup spring as a compression springs by insert molding an elastomer having a plurality of compressible members, such as a series of flat circular disks, on a portion of each spring arm so as to provide a desired compression spring force during outward deflection of the respective spring arm.

Another example method for retaining a tab within a receptacle in an electrical connector assembly includes: inserting a connector tab into the receptacle so as to contact an inward facing surface of each of a pair of spring arm retention features disposed within the receptacle; advancing the connector tab so as to displace each resilient arm laterally outward from an insertion axis along which the connector tab is inserted; contacting an outward facing surface of each arm with a corresponding backup spring member disposed within the receptacle; exerting a force with the backup spring member so as to reduce the stress within the arms; and mating the connector tab within the receptacle by advancing the connector tab until the spring arm retention features are resiliently received within corresponding recessed retaining features of the connector tab.

Yet another example method for retaining a connector plug within a receptacle in an electrical connector assembly includes: inserting a connector plug into the receptacle so as to contact an inward facing surface of each of a pair of spring arm retention features disposed within the receptacle; advancing the connector plug so as to displace each resilient arm laterally outward from an insertion axis along which the connector plug is inserted; contacting an outward facing surface of each arm with a corresponding lubricating member disposed within the receptacle so as to release a lubricant from the lubricating member onto a surface of each resilient arm, and; mating the connector plug within the receptacle by advancing the connector plug until the spring arm retention features are slidably received within corresponding recessed retaining features of the connector tab, wherein the lubricant facilitates sliding of the interfacing surfaces of the retention features. The methods may further include contacting the lubricating member with the displaced resilient arm so as to reduce the stress within the arms during insertion or to increase the retaining force of the retention mechanism To better understand the nature and advantages of the present invention, reference should be made to the following description and the accompanying figures. It is to be understood, however, that each of the figures is provided for the purpose of illustration only and is not intended as a definition of the limits of the scope of the present invention. In general, and unless it is evident to the contrary from the description, where elements in different figures use identical reference numbers, the elements are either identical or at least similar in function.

DETAILED DESCRIPTION OF THE INVENTION

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Figure 1:
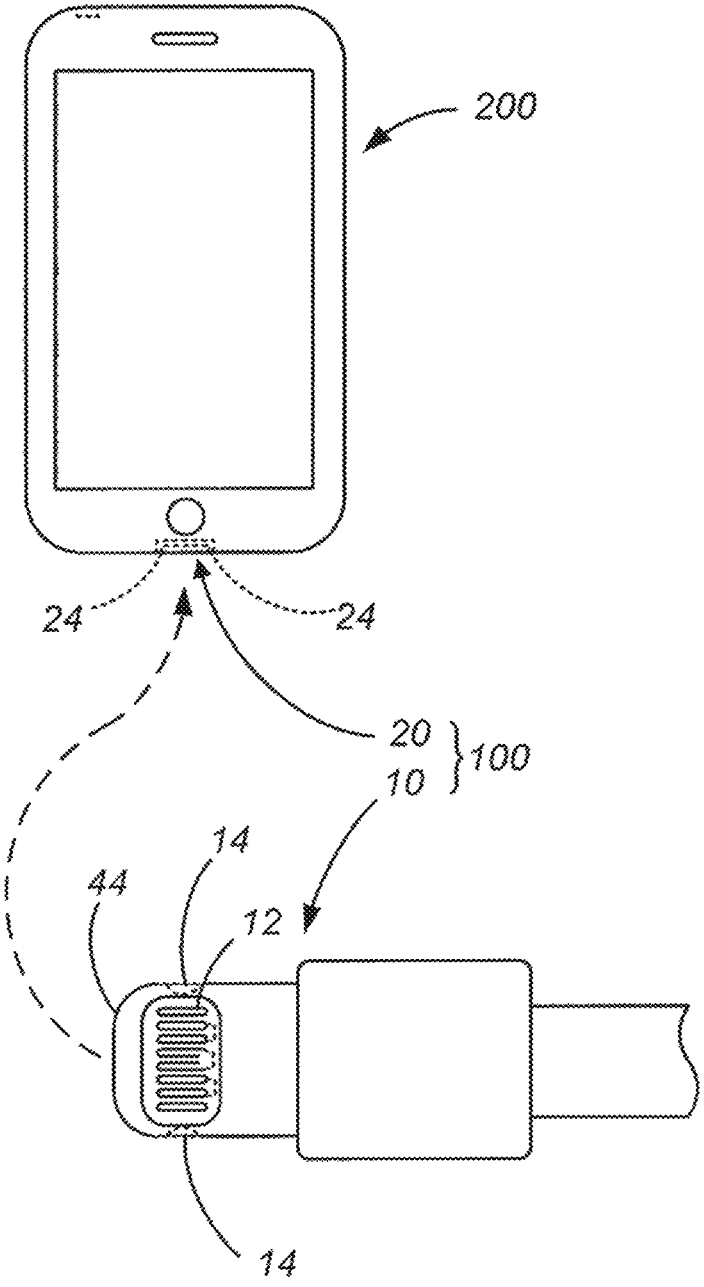
FIG. 1 shows an electrical connector device, in accordance with some embodiments.

In order to better appreciate and understand the present invention, reference is first made to FIG. 1 which is a simplified schematic representation of connector device 100 having a retention latch mechanism according to an embodiment of the invention. It is worth noting that the components in FIG. 1 are not drawn to scale. As shown in FIG. 1, connector device 100 includes a plug connector 10 compatible with a corresponding connector receptacle 20. Plug connector 10 may include multiple external electrical contacts 12 that can accommodate some or all of video, audio, data and control signals along with power and ground. Connector plug 10 connector tab 44 includes a tab portion 44 that is insertable into connector receptacle 20 of a host device 200 that can be, for example, a portable media player. Each of the connector plug 10 and the connector receptacle 20 includes retention features 14, 24, respectively, that engage when the connector plug 10 is fully inserted within the receptacle 20 in a mated configuration, so as to aid in the alignment and electrical contact between the components and maintain the components in the mated configuration.

Figure 2A:
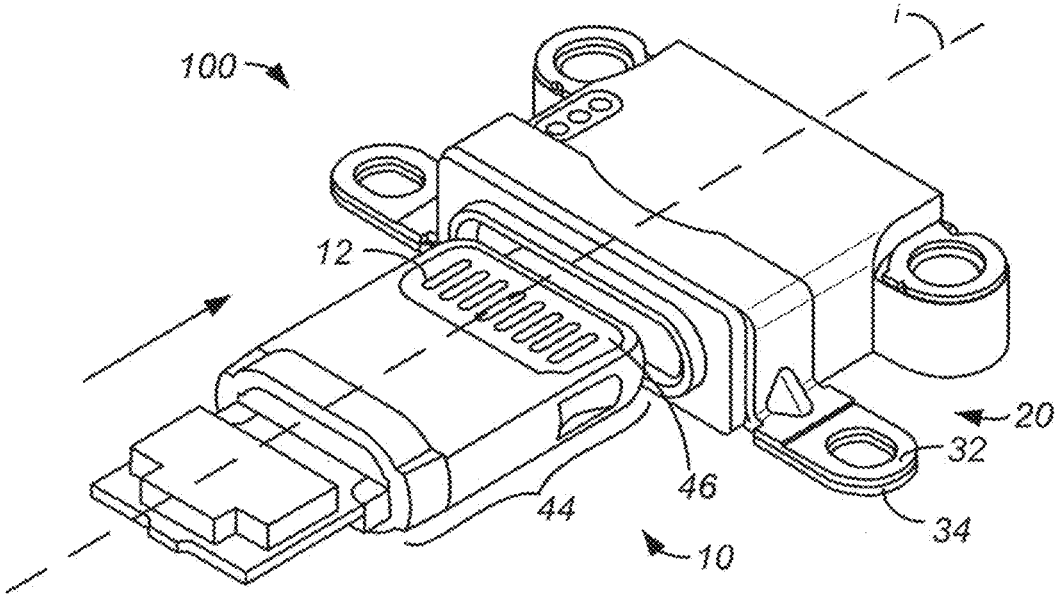
FIGS. 2A-2B an example electrical connector device.
Figure 2B:
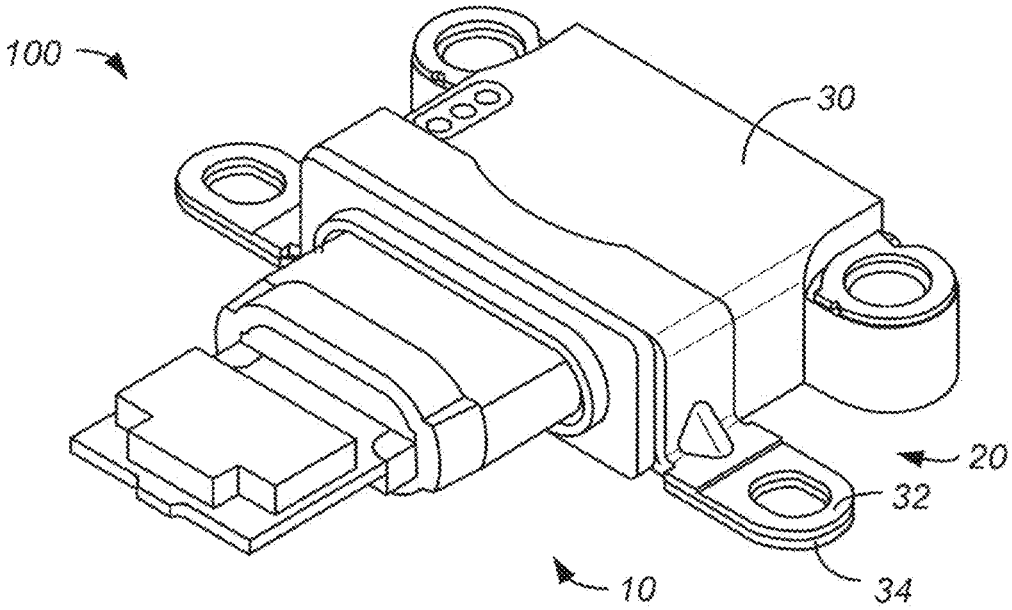

FIGS. 2A-2B illustrate an example electrical connector plug 10 before and after insertion into a compatible connector receptacle 20, respectively. As shown in FIG. 2A, the a connector tab 44 includes an electrical contact region 46 with multiple electrical contacts 12 for electrically coupling to corresponding electrical contacts (not shown) disposed inside the receptacle 20. The connector receptacle 20 is generally defined by an outer receptacle housing 30 that is attached to a surface or components on the interior of device 200, such as by use of one or more brackets 32, 34. In the embodiment shown, the connector receptacle housing 30 is coupled within the device using an upper bracket 32 that extends over the upper portion of the housing 30 and a lower bracket 34 that extends underneath housing 30. The end portions of each bracket 32 and 34 include holes for receiving a screw to facilitate mechanically coupling the housing 30 within the device 200. The connector plug 10 and connector receptacle 20 are connected by inserting the connector tab 44 along insertion axis (i) until the connector tab 44 is fully inserted into a mated configuration in which corresponding electrical contacts 12, 22 are electrically coupled, as shown in FIG. 2B.

Figure 3A:
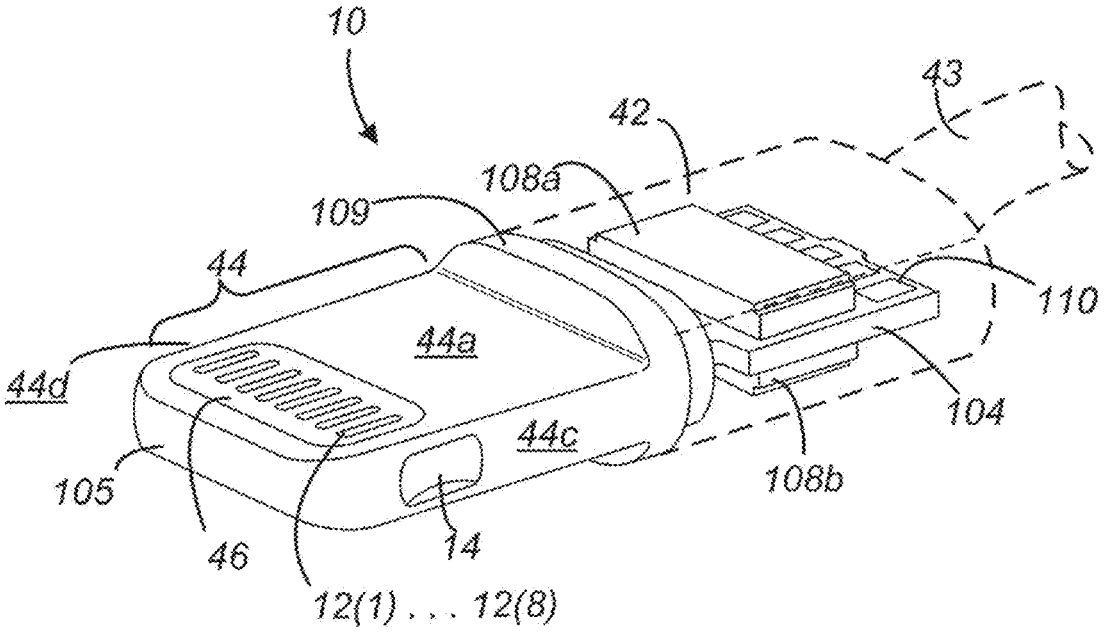
FIGS. 3A-3B show an alternate view of an example connector tab and receptacle an electrical connector device.

FIGS. 3A-3D illustrate embodiments of the connector tab 44 and connector receptacle 20 of FIGS. 2A-2B in further detail. FIG. 3A depicts the connector plug 10 having the insertable connector tab 44. Connector plug 10 includes a connector plug body 42 and the connector tab portion 44 that extends longitudinally away from body 42 in a direction parallel to the length of the connector plug 10. A cable 43 can optionally be attached to body 42 at an end opposite of connector tab 44. Body 42 is shown transparent form so that certain internal components are visible. As shown, within body 42 is a printed circuit board (PCB) 104 that extends into ground ring 105 between contact regions 46 and 46 towards the distal tip of connector plug 10. One or more integrated circuits (ICs), such as Application Specific Integrated Circuit (ASIC) chips 108*a* and 108*b*, can be operatively coupled to PCB 104 to provide information regarding connector plug 10 and any accessory or device that connector plug 10 is part of and/or to perform specific functions, such as authentication, identification, contact configuration and current or power regulation.

In the above embodiment, connector tab 44 is sized to be inserted into a corresponding connector receptacle 20 during a mating event and includes a first contact region 46 formed on a first major surface 44*a* extending from a distal tip of the connector plug to a spine 109 such that when connector tab 44 is inserted into the connector receptacle, the spline abuts a housing 30 of the connector receptacle or host device in which the connector receptacle resides. In one particular embodiment, connector tab 44 is 5.0 mm wide, 1.5 mm thick and has an insertion depth (the distance from the tip of connector tab 44 to spine 109) of 5.5 mm. In another embodiment, the connector tab 44 is 6.65 mm wide, 1.4 mm thick and has an insertable depth of 6.65 mm. Connector tab 44 may be made from a variety of materials including metal, dielectric or a combination thereof. For example, connector tab 44 may be a ceramic base that has contacts printed directly on its outer surfaces or may include a frame made from an elastomeric material that includes flex circuits attached to the frame. In some embodiments, connector tab 44 includes an exterior frame made primarily or exclusively from a metal, such as stainless steel, with a contact region 46 formed within an opening of the frame.

In this embodiment, contact region 46 is centered between the opposing side surfaces 44*c* and 44*d*, and a plurality of external contacts are shown formed on the top outer surface of connector tab 44 within the contact region. The contacts can be raised, recessed or flush with the external surface of connector tab 44 and positioned within the contact region such that when connector tab 44 is inserted into a corresponding connector receptacle they can be electrically coupled to corresponding contacts in the receptacle. The contacts can be made from copper, nickel, brass, stainless steel, a metal alloy or any other appropriate conductive material or combination of conductive materials. In some embodiments, contacts are printed on surfaces 44*a* using techniques similar to those used to print contacts on printed circuit boards. The contacts can be stamped from a lead frame, positioned within regions 46 and surrounded by dielectric material.

In one aspect, the connector tab 44 includes one or more retention features 14 corresponding to one or more retention features 24 within the receptacle 20. For example, the retention features of the connector tab 44 may include one or more indentations, recesses, or notches 14 on each side of connector tab 44 that engage with corresponding retention feature(s) 24 within the receptacle, the corresponding retention feature(s) 24 extending or protruding toward the insertion axis along which the connector tab 44 is inserted so as to be resiliently received within the indentation, notch or recess within the sides of connector tab 44. In one particular embodiment, retention features 14 are formed as curved pockets or recesses in each of opposing side surfaces 44*c*, 44*d*, the shape and location of the retention features 14 corresponding to complementary retention features 24 in the receptacle when in a mated configuration. In an embodiment, the retention features 24 of receptacle connector 20 include two opposing spring-like arms configured to be resiliently received within retention feature recesses 14 once the connector plug 10 and receptacle 20 are properly aligned and mated. The engagement of these resilient retention features of the receptacle and the retention feature within the connector plug can be seen in more detail in FIGS. 3C-3D.

In some embodiments, one or more ground contacts are formed on connector tab 44, or may be included on an outer portion of connector tab 44. In some embodiments, the one or more ground contacts are formed within and/or as part of a pocket, indentation, notch or similar recessed region 14 formed on each of the side surfaces 44*c*, 44*d* (not shown in FIG. 3*a*), such that the retention feature 14 may also act as the electrical ground for connector tab 44.

Figure 3B:
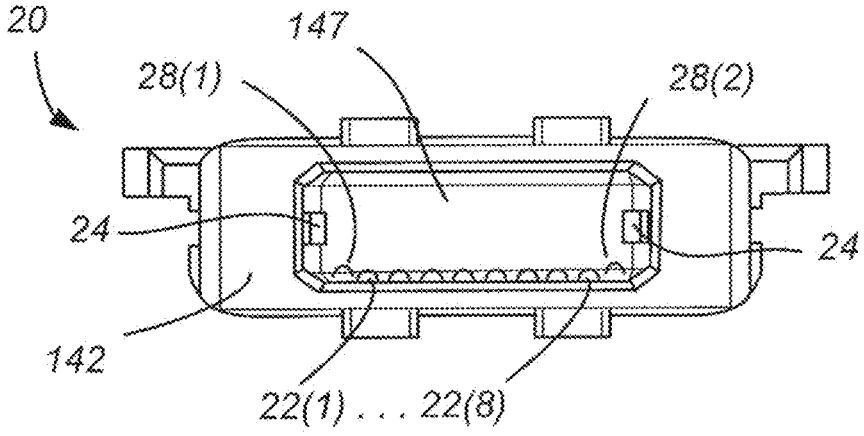

FIG. 3B depicts a connector receptacle 20 in accordance with some embodiments. The connector receptacle 20 includes side retaining features 24 that engage with corresponding retention features 14 on connector plug 10 to secure connector plug 10 within cavity 147 once the connectors are mated. In some embodiments, the retention features 24 are inwardly curved portions of resilient members or spring arms 26, often formed from an elongated arm that extends from a rear portion of the receptacle and extends toward the opening of cavity 147, such as shown in more detail in FIGS. 3C-3D. The retention mechanism may include one or more backup springs (not shown) that reduce stress within the retention features 24 or provide additional retaining force within the retention features 24 of spring arms 26 and may further include one or more lubricating members that release lubricant to a sliding interface within the retention mechanism during use (the lubricating members can also be used as backup springs). The retention spring arms 26 can be made from an electrically conductive material, such as stainless steel so that the retaining features 24 can also function as a ground contact. The connector receptacle 20 can also include two contacts 28(1) and 28(2) that are positioned slightly behind the row of signal contacts and can be used to detect when connector plug 10 is inserted within cavity 140 and/or when connector plug 10 exits the cavity 147. When connector tab 44 of connector plug 10 is fully inserted within cavity 147 of connector receptacle 20 during mating between the connector plug and connector receptacles, each of contacts 12(1) . . . 12(8) from one of contact region 46 are physically coupled to one of contacts 22(1) . . . 22(8).

In this embodiment, body 42 of connector plug 10 is generally the portion of connector 40 that a user will hold onto when inserting or removing connector 40 from a corresponding connector receptacle. Body 42 can be made out of a variety of materials and in some embodiments is made from a dielectric material, such as a thermoplastic polymer formed in an injection molding process. While not shown in FIG. 3A or 3B, a portion of cable 43 and a portion of connector tab 44 may extend within and be enclosed by body 42. Electrical contact to the contacts in contact region 46 can be made to individual wires in cable 43 within body 42. In some embodiments, cable 43 includes a plurality of individual insulated wires that are soldered to bonding pads on a printed circuit board (PCB) housed within body 42. Each bonding pad on the PCB is electrically coupled to a corresponding individual contact within one of contact region 46. Also, one or more integrated circuits (ICs) can be operatively coupled within body 42 to the contacts within regions 46 to provide information regarding connector 40 and/or an accessory the connector is part of or to perform other specific functions as described in detail below.

In one aspect, body 42 may be fabricated in any of a variety of suitable shapes, including a circular cross section, an oval cross section, or a rectangular cross-section. In some embodiments, such as shown in FIG. 3A, body 42 has a rectangular cross section with rounded or angled edges (referred to herein as a "generally rectangular" cross section), that generally matches in shape but is slightly larger than the cross section of connector tab 44. In some embodiments, both the body 42 and connector tab 44 of connector plug 10 have the same cross-sectional shape and have the same width and height (thickness). As one example, body 42 and connector tab 44 may combine to form a substantially flat, uniform connector where the body and connector plug seem as one. In still other embodiments, the cross section of body 42 has a different shape than the cross section of connector tab 44, for example, body 42 may have curved upper and lower and/or curved side surfaces while connector tab 44 is substantially flat.

Figure 3C:
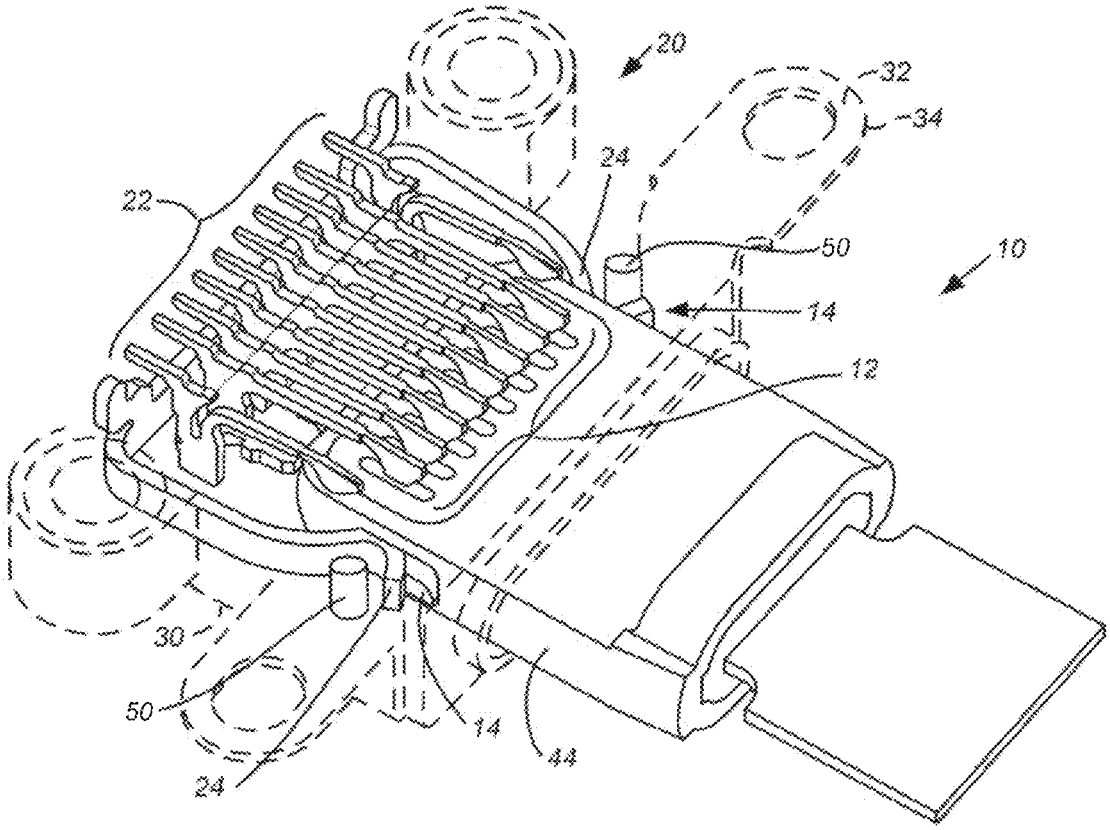
FIG. 3C shows an example connector plug having spring retention features and a cylindrical elastomer backup spring.

FIG. 3C depicts the connector tab 44 of plug 10 fully inserted into the connector receptacle 20 (the receptacle housing 30 is shown as transparent so that certain internal components are visible). As can be seen, when the connector tab 44 is fully inserted into the receptacle 20, the electrical contacts 22 engage with and electrically couple with the group of electrical contacts 12 on the top surface of the connector plug 10. Also, when the connector tab 44 is fully inserted and properly positioned within the receptacle 20 in the mated configuration, the corresponding retention features on each of the components are engaged, which helps ensure proper alignment of the components as well as retain the connector plug 10 within the receptacle 20, as shown in FIG. 3C. In some embodiments, the retention features 24 of the receptacle 20 are two spring-like resilient arms that extend from a rear portion of the receptacle housing 30 along each side of the receptacle housing 30 toward the opening of the cavity in which connector tab 44 is inserted, outside of which are disposed a pair of backup springs, shown here as elastomeric cylinders 50. As each spring arm is outwardly displaced during insertion of the connector tab 44, each spring arm contacts an associated cylindrical elastomeric backup spring 50.

Figure 15A:
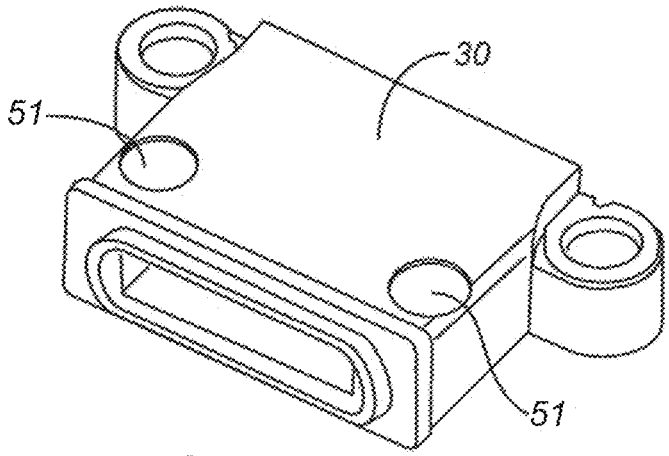
FIGS. 15A-15C show an example connector receptacle assembly, a connector receptacle, and a lubricating member, respectively.
Figure 15C:
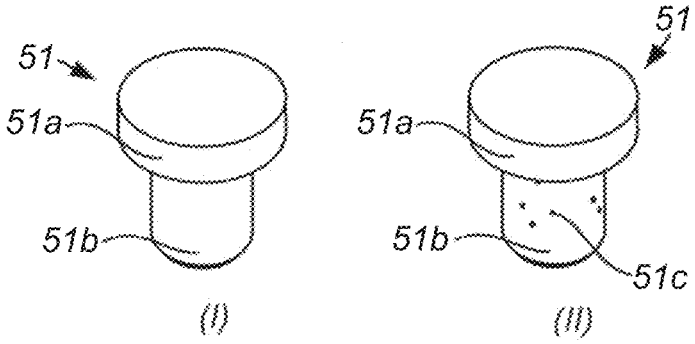
Figure 17A:
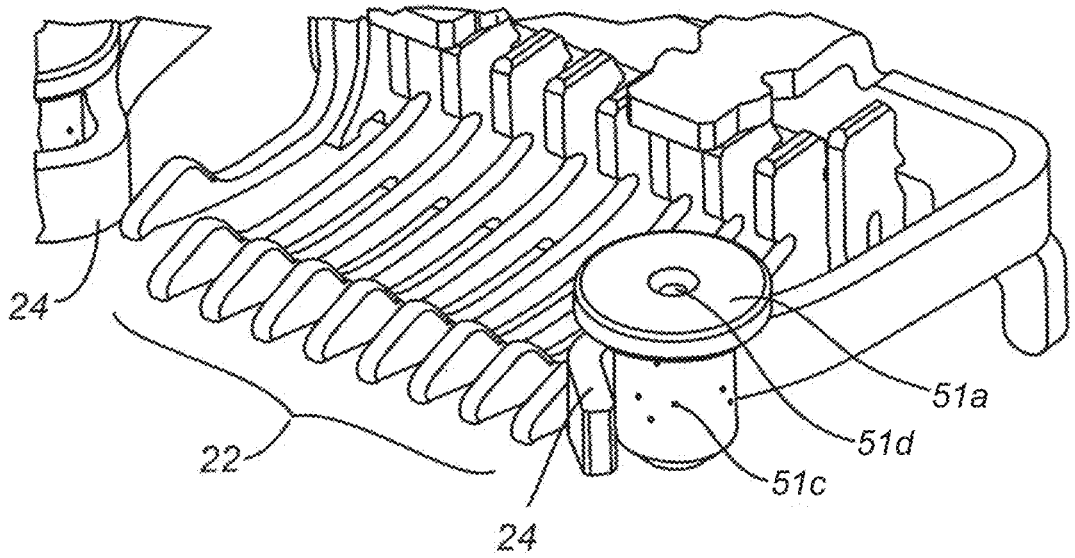
FIGS. 17A-17B illustrate an example retention feature and a self-lubricating backup spring.

In some embodiments, the retention mechanism may include a lubricating member 51, such as shown in FIGS. 15C and 17A, that releases lubricant onto a sliding interface of the retention mechanism when contacted by the retention spring arm features 24. The lubricating members 51 are disposed adjacent an outer facing side of the retention features 24 or associated spring arm 26 so that when the spring arms 26 are displaced laterally outward during insertion, the spring arm 26 contacts the lubricating member 51 thereby releasing a lubricant onto a surface of the retention spring 26. The lubricating member 51 is configured and positioned so that when engaged, the lubricant is released from the lubricating member 51 to a sliding interface of the retention feature 24, such as through surface contact, capillary action, or movement of the components during cycling. For example, in the case of a paste or liquid lubricant, the lubricant may flow through surface contact over the retention feature to the interfacing surface, or in the case of a solid, such as a powdered PTFE, the lubricant would fall or travel as air-borne dust to deposit on the adjacent interfacing surfaces of the retention features. In some embodiments, the mechanism may include a spring arm 26 having a retention feature 24 and a hole therethrough or groove near the sliding interface to facilitate transfer of lubricant along the retention feature 24 to the sliding interface. The lubricating member 51 may be configured as a cylindrical elastomeric member, similar to the cylindrical elastomeric backup spring 51 in FIG. 2C, so that the lubricating member 51 can also perform as a backup spring.

Figure 3D:
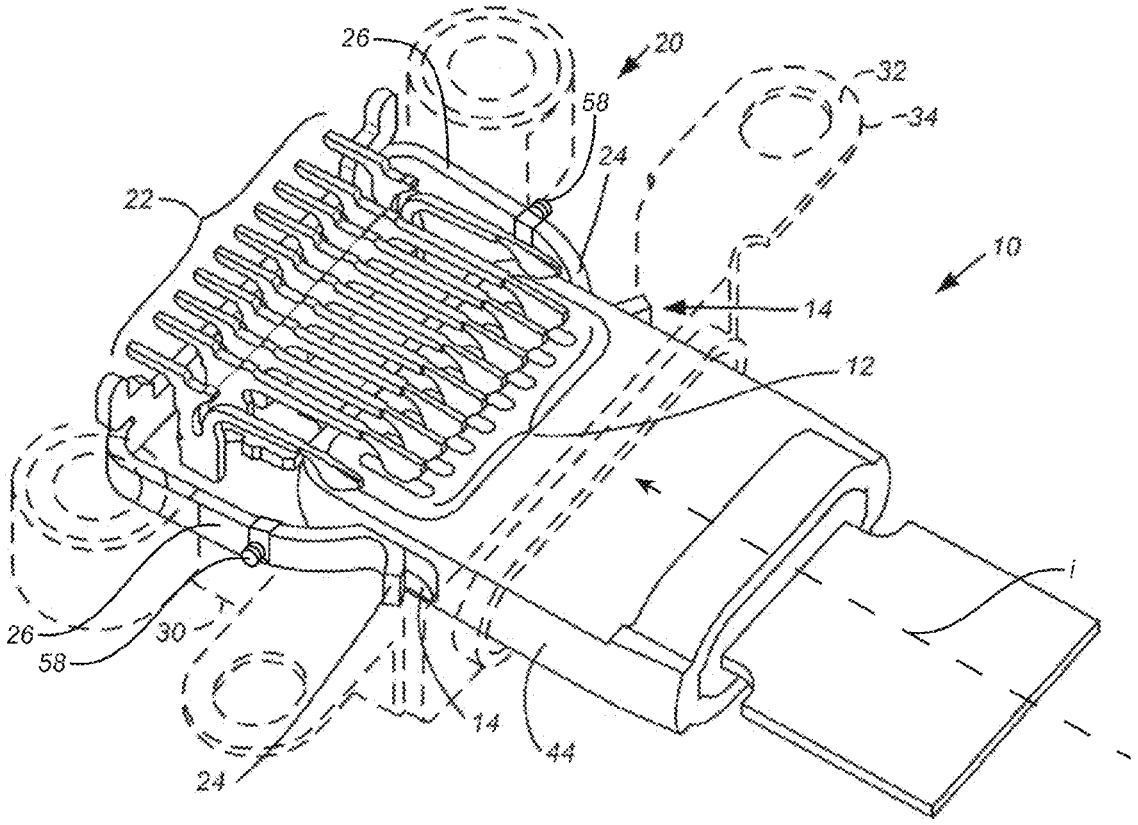
FIG. 3D shows an example connector plug having spring retention features with attached compression springs as backup springs.

FIG. 3D shows an embodiment having compression springs 58 as backup springs, the compression springs 58 being mounted on a portion of each spring arm 26 adjacent the inwardly curved retaining portion 24. Each compression spring 58 defined by a plurality of circular elastomeric members aligned along a lateral axis (x) that extends laterally outward from each spring arm 26 so that lateral deflection of the spring arms away from insertion axis (i) along lateral axis (x) compresses each spring 58 against the receptacle housing and exerts a counter force on each spring arm 26 according to the spring constant of the compression spring 58.

As shown in FIGS. 3A-3D, the first and second retention features 14 may be formed on the opposing sides of connector tab 44 within ground ring 105 and are adapted to engage with one or more corresponding features within the connector receptacle 20 to secure the connectors together when mated. In some embodiments, the retention features 14 are semi-circular indentations in the side surfaces of connector tab 44. The retention features may be widely varied and may include angled indentations or notches, pockets that are formed only at the side surfaces and do not extend to the top surface 44 or opposing bottom surface. In one aspect, the resilient spring arms 26 of the receptacle 20 comprises a tip or an angled or curved surface (such as the inwardly curved portion) 24 shown in FIGS. 3A-3C that slides into and fits within the recessed retention features 14 of the connector plug 10.

In some embodiments, the retention features 24 of the receptacle are designed so that the curved portion that engages with the corresponding retention features 14 of the connector tab 44 positioned near the opening of the receptacle cavity in which connector tab 44 is inserted. This may help better secure the connector sideways when mated within the connector receptacle. It is appreciated however, that either of the retention features could be located or positioned in any suitable location so that when engaged the retention features help retain the connector components in the proper alignment in the mated configuration.

Figure 4:
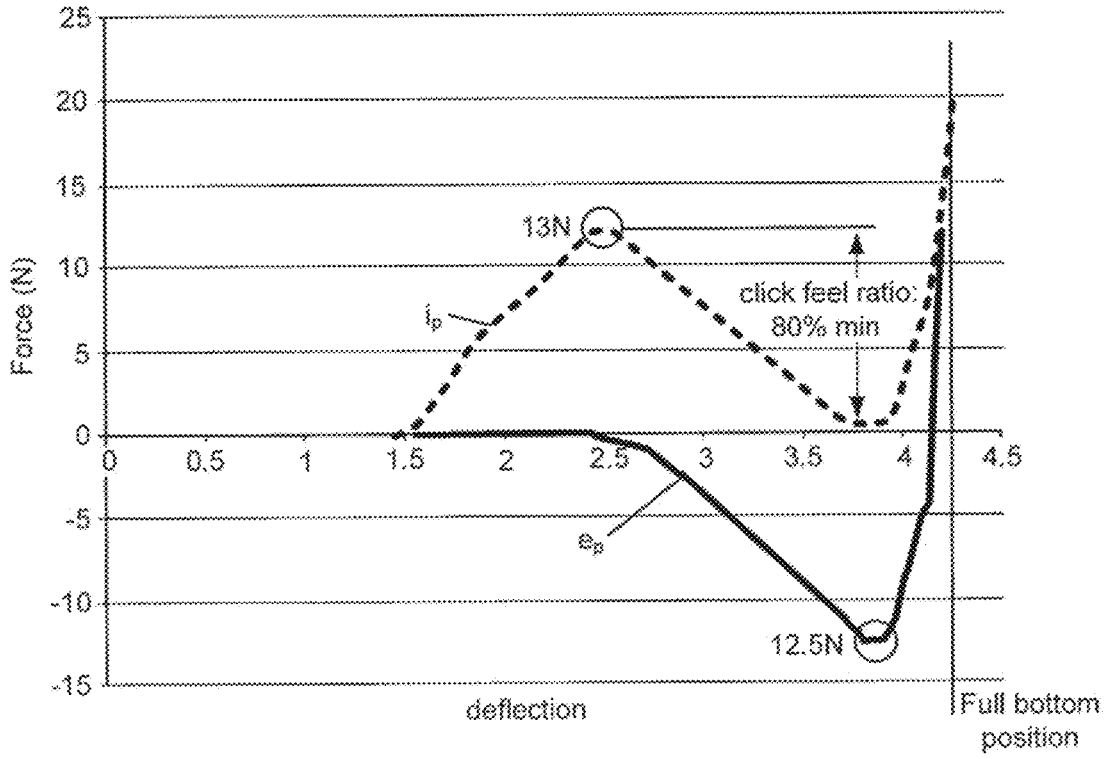
FIG. 4 shows an insertion and extraction performance profile relating to testing of an example electrical connector device.

In an example embodiment, the angled and curved surfaces of corresponding retention features of the connector tab 44 and the connector receptacle 20 are configured so as to provide a desired insertion force and extraction force, such as the forces depicted in the insertion/extraction force profile shown in FIG. 4. The retention features of each of the connector plug and the connector receptacle can be designed or modified, such as by increasing or decreasing the curvature of one or both features or by changing the spring force exerted by the resilient arm, so as to provide desired insertion and extraction forces. In some embodiments, the force required to extract the connector tab 44 from the receptacle 20 is greater than the force required to insert the connector tab 44 into the receptacle 20. This aspect increases ease of use by allowing a user to easily insert the connector tab 44 of the connector plug 10 into the receptacle 20, and recognize when the connector tab 44 is properly positioned due to the tactile response resulting from engagement of the corresponding retention features, and further prevent inadvertent or accidental withdrawal of the connector plug 10 from the receptacle 20. As described above, in embodiments utilizing features similar to those in FIGS. 3A-3D, the insertion and extraction forces may vary according to a variety of factors that may include the angle or curvature of the recess and/or the corresponding resilient arm, as well as the material and width of the resilient arm itself.

Another factor affecting the force profile is the friction between the sliding, interfacing surfaces of corresponding retention features 14, 24. While the retention features may be configured to provide a desired insertion/retraction force profile, the force profile of corresponding retention features may differ between a lubricated state and a non-lubricated state. Thus, maintaining a lubricated state between corresponding retention features by using a lubricating member provides for more consistent insertion/retraction forces over many cycles of use.

Figure 5A:
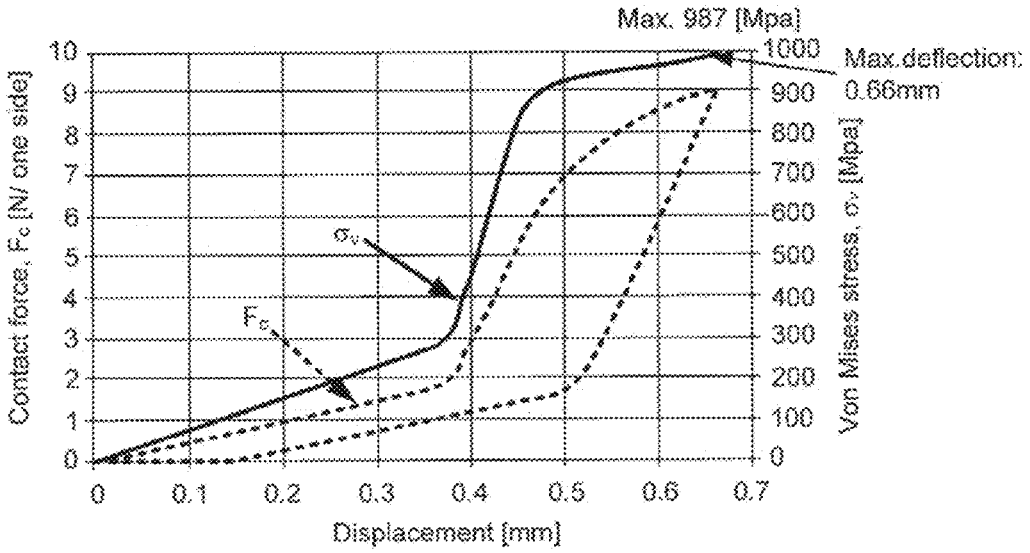
FIGS. 5A-5B show the contact forces and stresses associated with use of many electrical connector devices.
Figure 5B:
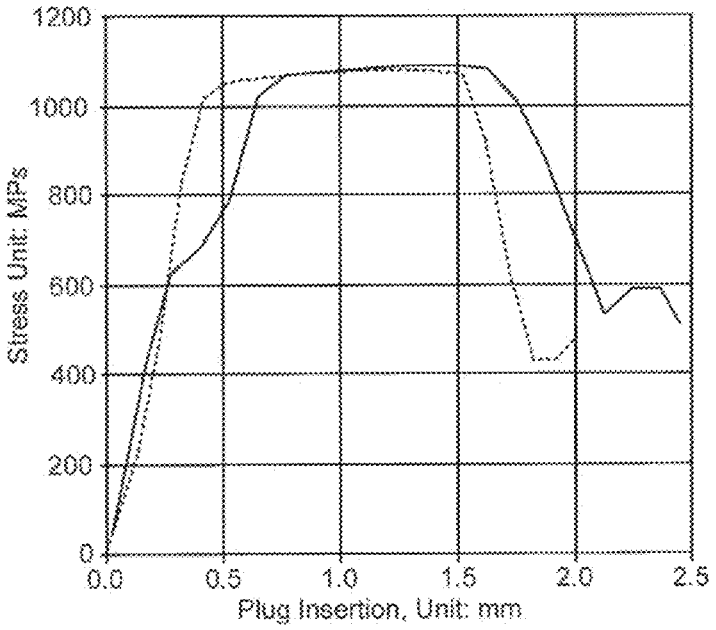

While the retention features described above offer significant advantages in many connector designs, these features may present additional challenges. For example, in an embodiment where the receptacle includes retention features comprising a pair of resilient arms extending on opposite sides of the receptacle, the lateral movement of the resilient arms while the connector plug is being inserted may result in substantial contact forces and stresses within the resilient arms or springs. Repeated cycling of these stresses and contact forces over many cycles of use may ultimately cause material failure or fatigue failure, resulting in cracking or breaking of the resilient arm. An example of typical contact forces and stresses associated with insertion and retraction of many connector devices using retention features similar to those described above is shown in FIGS. 5A-5B. As can be seen in FIG. 5A, in some connector devices, the contact forces can cause lateral deflection of a resilient arm retention feature to exceed a maximum allowable deflection, which would result in material failure.

Examples of material properties associated with materials commonly used in connector assemblies using in accordance with some embodiments are presented in Table 1 below. In an example embodiment, 301 3/4h Stainless Steel is used for the spring arms retention features due to its high stiffness and forming ability. In some designs, material failure was noted after cycles of use ranging from 2,000 to 7,000 cycles. Use of a stress reducing member, such as a backup spring, allows for a connector assembly having a retention latch, such as described herein, to operate for over 10,000 cycles of use without material failure. In some embodiments, the lubricating member is integral with the backup spring, although it is appreciated that a lubricating member may be used in combination with one or more backup springs, such as any of the example backup springs referred to above. The use and advantages of a backup spring are described in more detail below.

TABLE 1

Material Properties for Selected Spring Arm Materials

| | | E | Tensile Strength | Yield Strength | Fatigue/Endurance Limit |
|---|---|---|---|---|---|
| 301 3/4 h | L-direction | 193 GPa | 1250 MPa | 950 MPa | 850 MPa |
| 301 3/4 h | C-direction | 193 GPa | 1180 MPa | 850 MPa | 750 MPa |
| 301 h | L-direction | 193 GPa | 1400 MPa | 1250 MPa | 1000 MPa |
| 301 h | C-direction | 193 GPa | no data | no data | 850 MPa |

Figure 6A:
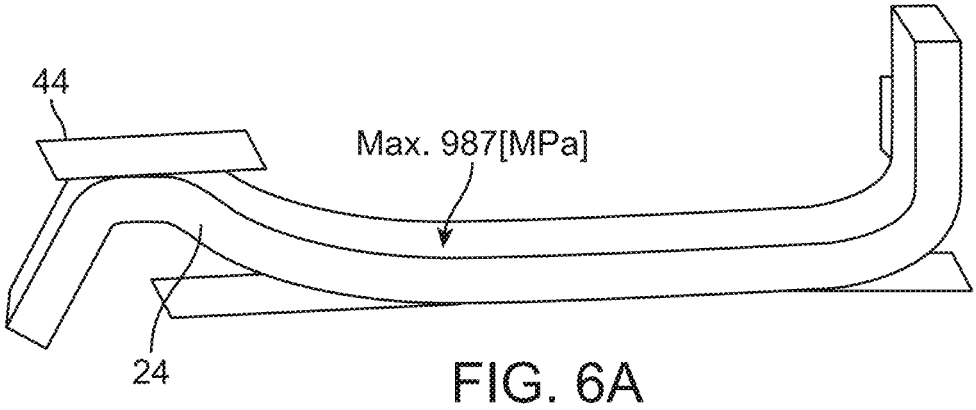
FIGS. 6A-6B show the locations of contact forces and stresses as seen in many electrical connector devices.
Figure 6B:
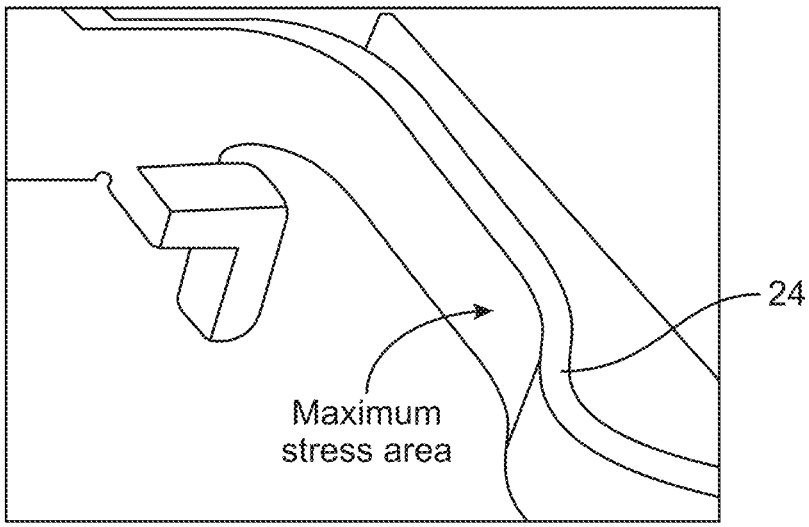

Examples of such forces and stresses are illustrated in the stress models of the resilient arm shown in FIGS. 6A-6B. Although the strength of the material can be modified by using a thicker or different material, generally such modifications affect the flexibility of the arm, which may result in an undesirable insertion/extraction profile. In an example embodiment, the connector includes a resilient stress reducing member that reduces the stresses and contact forces within the resilient arm without reducing the spring force of the arm when mated. In some embodiments, the use of one or more stress reducing members, such as a backup spring, allows for a desirable insertion/extraction profile using the above described retention features without the aforementioned drawbacks of many designs relating to material failure.

In some embodiments, a retention mechanism is configured with a backup spring or secondary spring configured to reduce stress within the spring arms 26 and/or to provide additional retaining force within the spring arms 26. The backup springs, such as any of those described herein, can be positioned adjacent or outside the angled or curved retaining portion 24 that is received within the corresponding recess of the tab, to directly counter the forces applied by the connector tab 44 during insertion, although the backup spring may be placed in other locations, such as closer to a mid-point of the resilient arm or closer to a rear portion of the resilient arm. Generally, the stress reducing member is positioned adjacent a side or outer surface of the resilient arm which faces away from the insertion axis along which the connector plug is inserted into the receptacle cavity to allow the inner surface of the resilient arm to contact connector plug during insertion and be received within the recess of the connector tab. As the one or more resilient arms are displaced laterally outward during insertion of the connector tab, the resilient arm(s) contact and press against the stress reducing resilient member which helps relieve some of the forces exerted against the resilient arm(s) by the connector plug and the stresses within.

In some embodiments, a backup spring or secondary spring is configured so that there is a gap between the member and the resilient arm 24 before the connector tab 44 is inserted such that inserting the connector tab 44 displaces the resilient arms 24 laterally outward closing the gap. In some embodiments, a similar gap may be formed as the resilient arms 24 are received within the recessed features 14 in the mated configuration (the gap being smaller than the gap prior to insertion), or alternatively the retention features may remain in contact when in the fully mated configuration. In some embodiments, designing these features so that they remain in contact in the mated configuration may be useful when a lubricating member is used as a backup spring to provide additional retention force in the mated configuration and/or may be used as a ground path for the ground ring. In other embodiments, the backup spring may be in contact with the resilient spring arms 24 before and/or after insertion of the connector tab 44 into the receptacle 20.

Figure 7A:
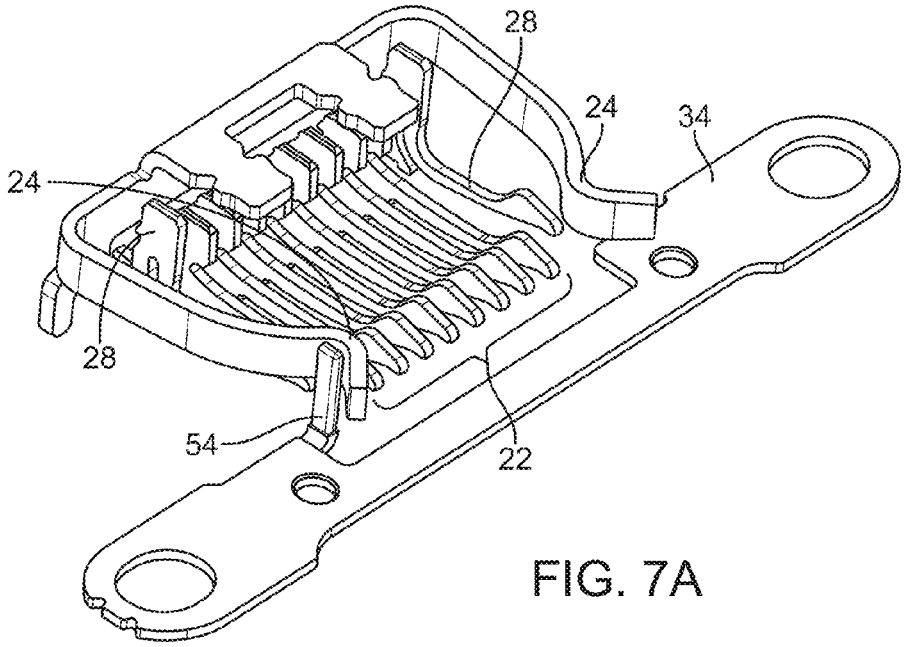
FIGS. 7A-7B show an example connector receptacle of an electrical connector device.
Figure 7B:
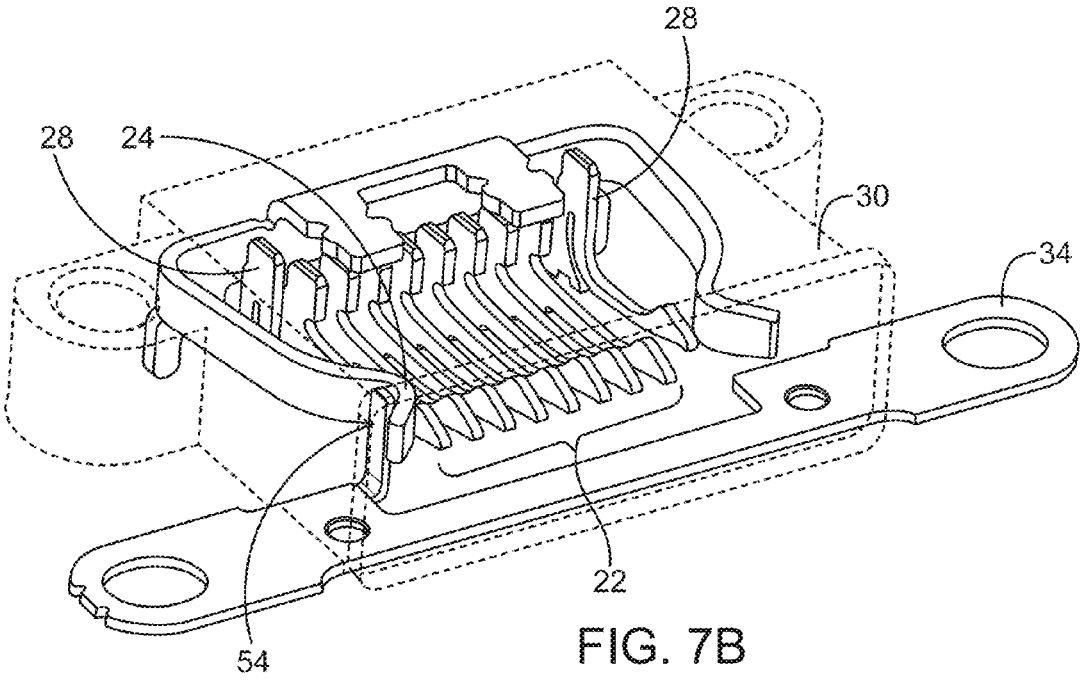

In some embodiments, the backup spring is formed by a portion of the housing and/or the brackets that secure the receptacle housing within the device. FIGS. 7A-7B illustrate an embodiment in which the backup spring is defined by a tab-like portion 54 of the lower bracket 34. The tab-like portion may be formed during fabrication of the bracket by bending a relatively small portion of the bracket away from the remainder of the bracket. Bending a small tab-like portion upward, typically perpendicular to the rest of the bracket, allows the tab-like portion to function as a spring or resilient member. When the bracket 32 is assembled with the receptacle housing 30 having the electrical contacts 24 and the resilient arm retention features 24 disposed within, the tab-like portion is disposed adjacent the resilient arm 146, typically adjacent the angled or curved portion that is received with the corresponding recess of the connector tab. Although only one bent tab 54 is shown in the embodiment in FIGS. 7A-7B, typically a bent tab is placed adjacent an outer facing surface of each of a pair of resilient arms disposed within and extending along opposing sides of the receptacle housing 30.

Figure 8A:
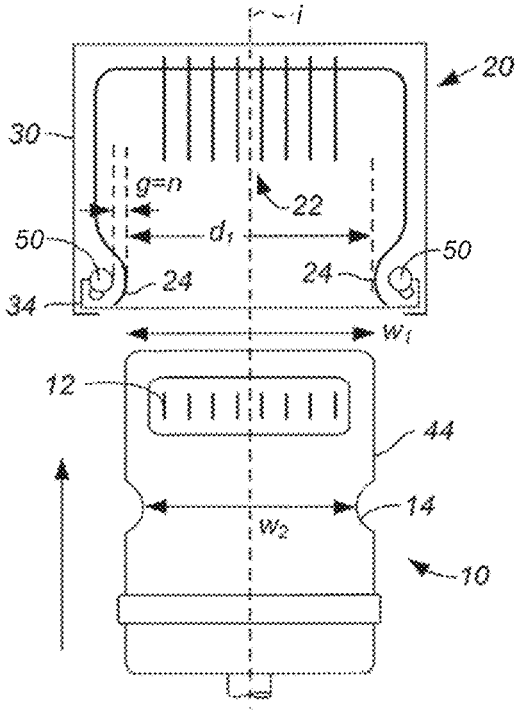
FIGS. 8A-8C illustrate sequential cross-sections along an insertion plane showing the insertion of an example connector plug into a connector receptacle.
Figure 8B:
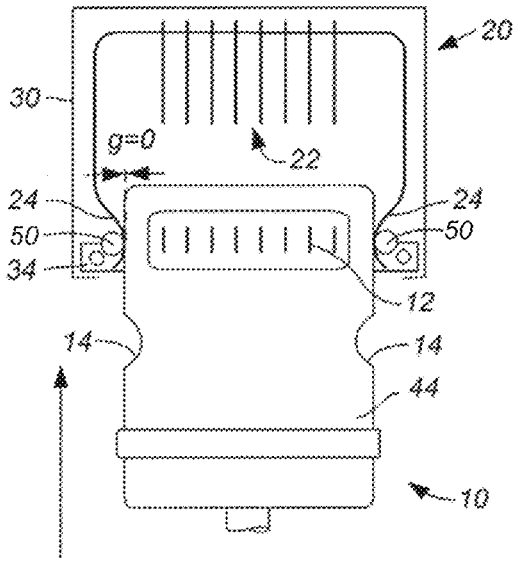
Figure 8C:
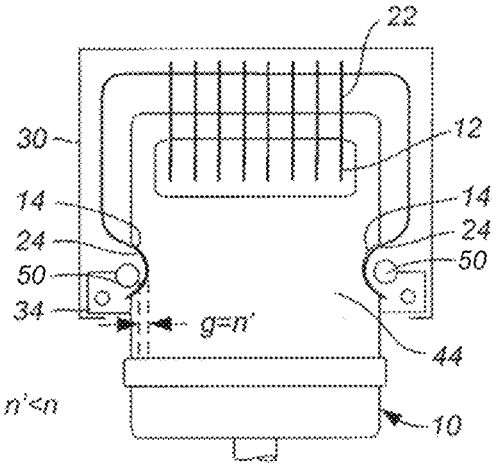

The use of a backup spring within a retention mechanism can be further understood by referring to FIGS. 8A-8C, which sequentially illustrates the insertion of a connector tab into a receptacle having elastomeric cylinders 50 as backup springs, although it is appreciated that any of the backup springs described herein could be used with similar results. In FIG. 8A, an example embodiment having a resilient stress reducing member, such as described in FIGS. 7A-7B, is shown prior to insertion of the connector tab 44. As can be seen, the width of the front portion of the tab 44 (w1) is wider than the distance between the curved portions of the resilient arms 24 (d1) of the receptacle so that insertion of the tab 44 displaces the spring arms 24 laterally outward toward the elastomeric cylinders 50 acting as backup springs. Additionally, the distance between the backup springs 50 is also less than w1 so that when insertion of the tab 44 laterally displaces the resilient arms 24, each arm is contacted by the corresponding adjacent backup spring 50, thereby reducing the stresses within each resilient arm. It can also be seen that the width (w2) between the recessed retention features 14 is greater than the distance d1, so that when the plug 10 and receptacle 20 are in the mated configuration, the spring arms 24 exert a force on the tab 44 toward the insertion axis (i). In the illustrated embodiment, the backup spring 50 is configured so that there is a relatively small gap (g). The magnitude of the gap in this configuration (n) may be relatively small, such as a 0.1 mm to 4 mm gap. connector tab FIG. 8B illustrates insertion of the leading portion of the tab 44 into the receptacle 20 between the spring arms 24, which displaces each of the spring arms 24 laterally outward, away from the insertion axis (i) and against the elastomeric cylinder 50 acting as a backup spring. The backup spring 50 counters the force applied by the tab 44 and transfers this force along the bracket 34. In an example embodiment, an elastomeric cylinder 50 is included on the outside of each of a pair of spring arms 26 to act as backup springs. Using opposing spring arms, each having a backup spring, is advantageous as this further distributes the stresses as well as providing a more uniform retention force in the mated configuration. Additionally, utilizing a pair of spring arms 24 as well as a pair of backup springs configured so that the forces applied to such springs are in opposing direction is further advantageous as these opposing forces can be resolved within the U-shaped metal bracket comprising the resilient arms and within the upper and/or lower bracket comprising the backup springs. Generally, the force of the elastomeric cylinder 50 exerted inward against the outer facing surface of the resilient arms is proportional to the outward distance by which the backup spring is displaced. This aspect helps keep the contacts forces and stresses within the resilient arms below the threshold and/or helps keep the lateral displacement of the resilient arms within a desired range so as to avoid failure or interference with adjacent components.

FIG. 8C illustrates the connector plug 10 fully inserted within the receptacle 20 within the mated configuration, each of the electrical contacts 12 of the connector plug 10 electrically coupled with the electrical contacts 22 of the receptacle 20. As can be seen, the curved portions of the spring arm retention features 24 are engaged within the recessed retention features 14 of the connector plug 10 and the distance between the spring arms is w2, such that the spring arms are outwardly displaced in the mated configuration so as to provide a retaining force against the sides of the connector tab 44 as well as to ensure electrical contact so that the springs arms may function as a ground path for the ground ring of the connector plug 10. In some embodiments, there may be a gap between each of the elastomeric cylinders 50 and the associated spring arm 24 so that the inwardly directed retention force between the spring arm 24 and the connector tab 44 is proportionally related to the outward displacement of the spring arms 24 in the mated configuration. In such embodiments, the magnitude (n) of the gap in this configuration would be less than the magnitude (n) of the gap before insertion of the connector tab. In some embodiments, the elastomeric cylinders 50 may be configured so that contact between the elastomeric cylinders 50 and the resilient arms 24 is maintained in the mated configuration, such that the inwardly directed retention force on the tab 44 is a proportionally related to the displacement and spring constant of each of the elastomeric cylinders 50 and the spring arms 26. This aspect may be useful in that the retention force may be adjusted by utilizing different brackets 32, 34 rather than modifying the resilient spring arms 26. This may also be useful as this may provide an additional ground path through the brackets to which the elastomeric cylinders 50 may be connected.

Figure 9A:
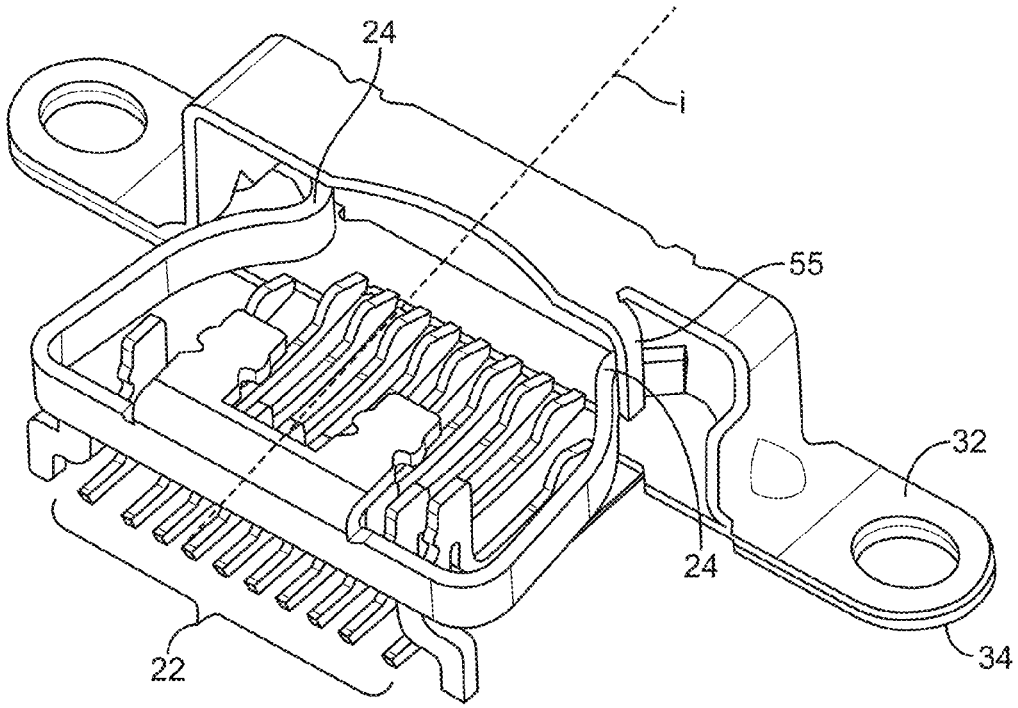
FIGS. 9A-9C show an example connector receptacle of an electrical connector device.
Figure 9B:
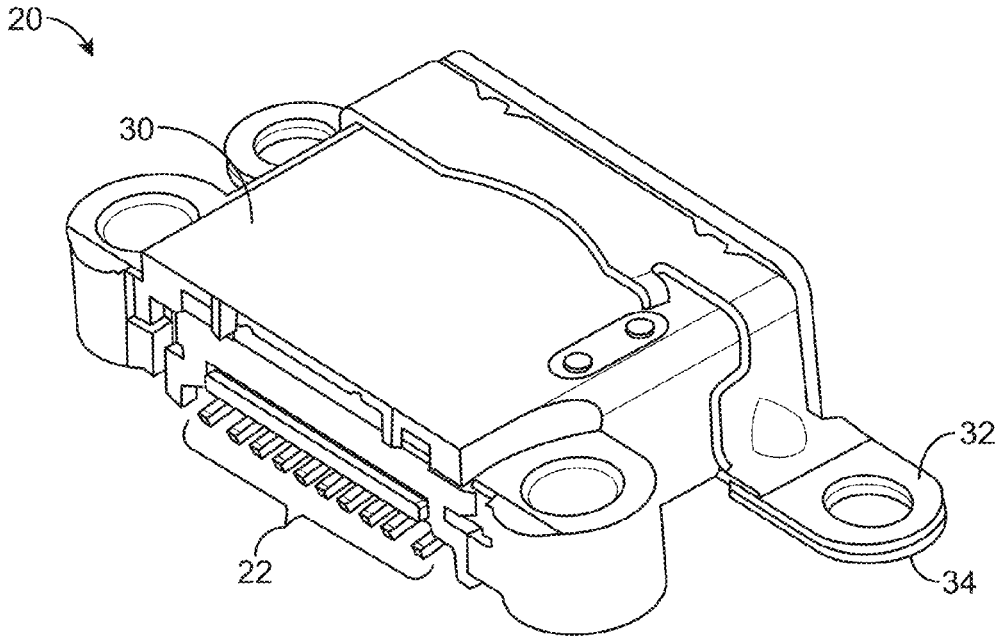
Figure 9C:
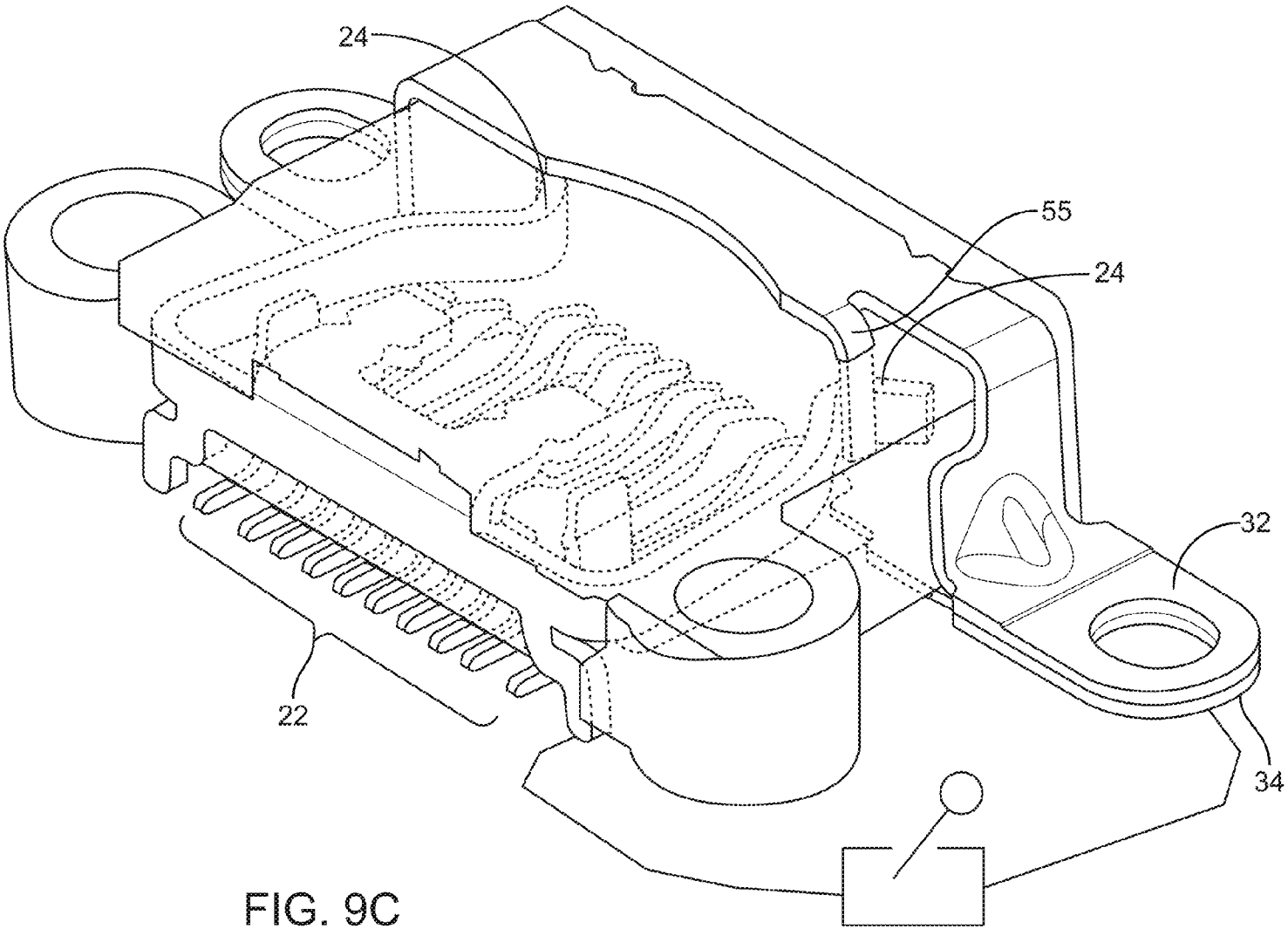

FIGS. 9A-9C illustrate an alternative embodiment, where the stress reducing member is a backup spring formed by a bent tab 55 extending from the upper bracket 32. The upper bracket 32 may be fabricated with an arm that extends toward the rear portion of the receptacle housing 30 and down through a hole in the top surface of the housing 30 (indicated by the arrow) so as to extend along a side of the curved portion of the resilient arm facing away from the insertion axis (i).

Although this bent tab 55 is depicted only on one side in FIGS. 9A-9B, typically the bent tab 55 would be included on each of the spring arms 26 so as to more evenly distribute forces and reduce stresses during insertion of the tab 44. FIG. 9C graphically depicts a circuit schematic overlayed an example device to show how a bent arm 55 acting as a backup spring may be used as a ground path for the receptacle 20, or alternatively, how the circuit may be used to detect when the backup spring is contacting resilient arms, which may be particularly useful in optimizing or configuring the backup spring to provide a desired force.

Figure 10:
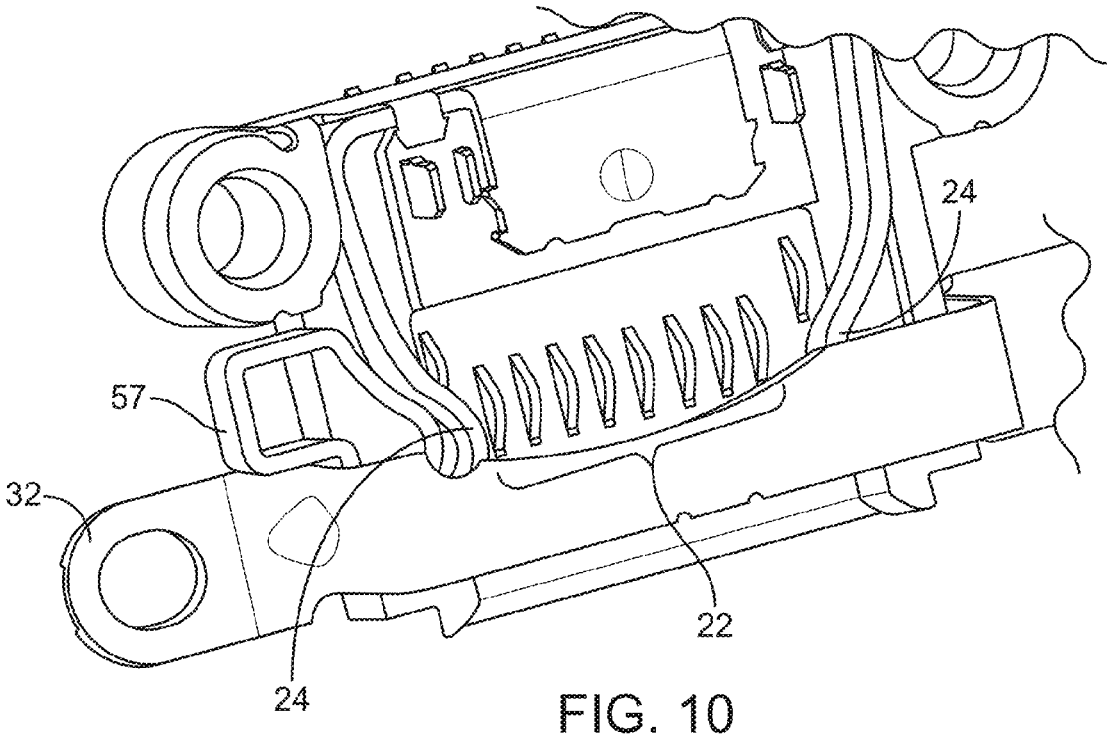
FIGS. 10-14 show example connector receptacles of an electrical connector device.

FIG. 10 illustrates an alternative embodiment, wherein the backup spring comprises a loop 57 extending along a plane that is parallel to the plane along which the tab 44 is inserted. The loop may be configured in a variety of differing shapes, such as that shown in FIG. 10 designed so as to complement the curved portion of the resilient arms. Typically, as the spring arms 26 extend outward, the loop 57 compresses thereby exerting an inwardly directed force on the spring arms 26 to counter the forces from the tab 44 during insertion and reduce the stress within the spring arms to desired levels.

Figure 11:
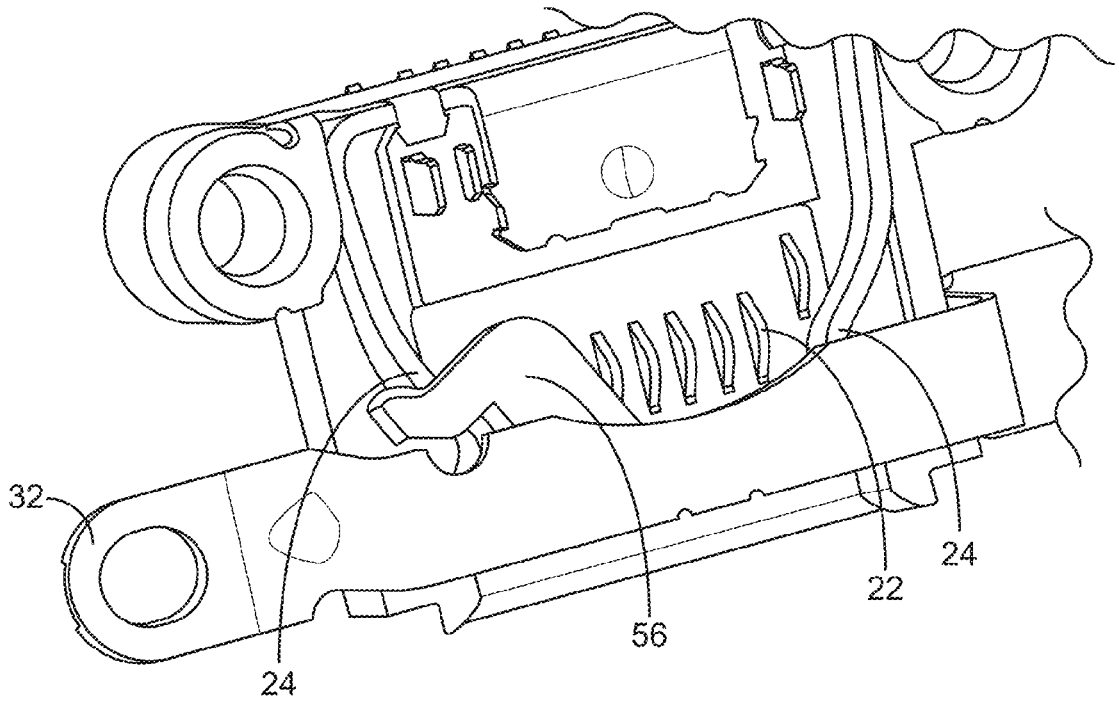

FIG. 11 illustrates an alternative embodiment, wherein the backup spring is defined by a bent arm 56 extending laterally from the upper bracket 32 a distance toward the rear portion of the receptacle 20 before extending down along an outer facing side of a respective spring arm 26. In this embodiment, the bent-down portion of arm 56 is positioned adjacent a portion of the spring arm 26 preceding the curved portion forming the retaining feature 24 that engages the recessed retention features 14 of tab 44.

Figure 12A:
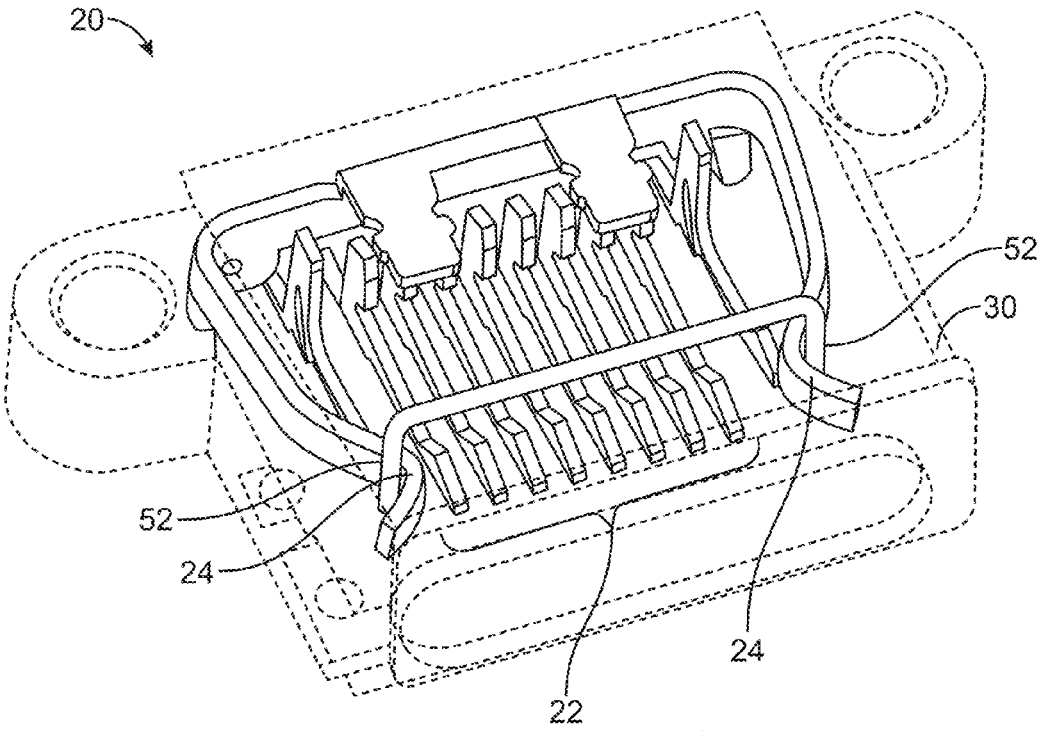
Figure 12B:
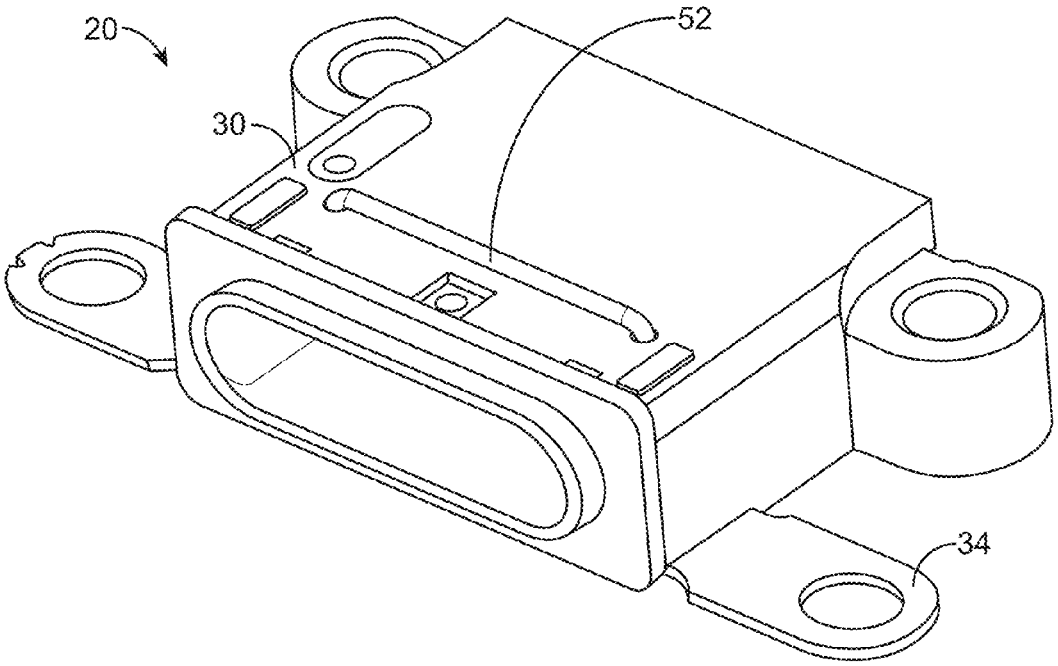

FIGS. 12A-12B illustrate an alternative embodiment, wherein the backup spring comprises a bent wire 52, such as standard 0.3 mm piano wire or music wire, the wire having bent end portions resembling an undeployed staple. The end portions are bent at an angle, typically about 90 degrees, and inserted through corresponding holes in the top surface of the housing 30 so as to extend through the housing 30 and alongside the outer facing surface of the spring arms 26. Generally, the bend end portions are positioned adjacent the curved portions retaining features 24 that are received within the corresponding recessed retention features 14, such as shown in FIG. 12A (the housing 30 shown as transparent so that certain internal components are visible). This configuration is advantageous in that modification of the brackets 32, 34, such that existing connector assemblies can be easily retrofitted with the backup spring as described above to reduce stresses within the resilient arms and prolong the useful life of the connector assembly.

Figure 13:
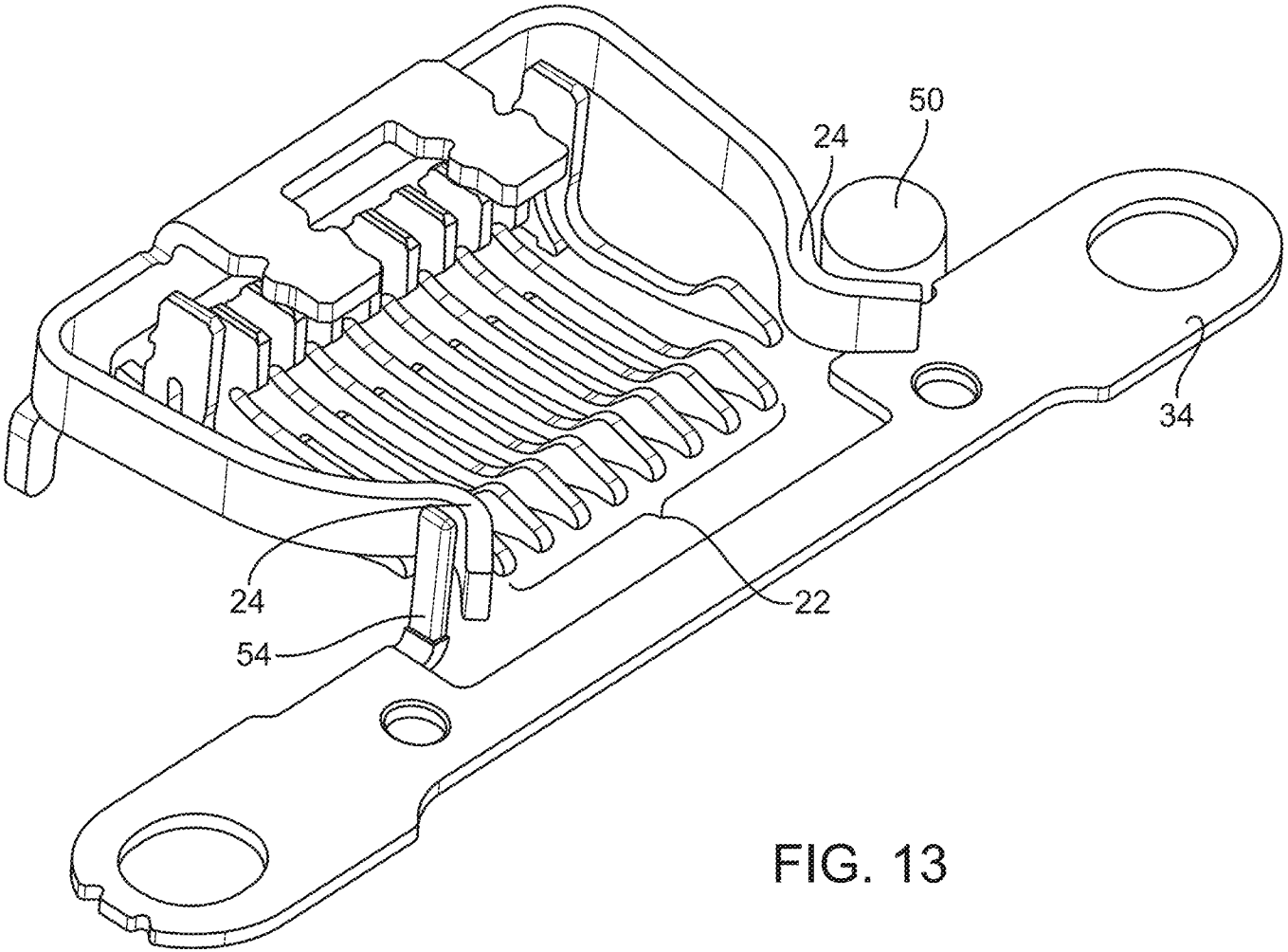

FIG. 13 illustrates an alternative embodiment in which different types of backup springs are combined, here, the backup springs include an elastomeric cylindrical member 50 and a bent tab 54, each acting as a backup spring to exert an inwardly directed force against the spring arms 26. Typically, the cylindrical member is positioned adjacent the retaining features 24 of the spring arms 26 as shown in FIG. 13, and may be attached to the brackets, 32, 34, the housing 30 or any suitable component so as to function as a stress reducing member as described above. While FIG. 13 shows the bent tab 54 on one side and a cylindrical elastomeric member 50 on the other, it is appreciated that various combinations of any of the backup springs described herein could be used. Although the cylindrical elastomeric member 50 is shown as a cylindrical member, it is appreciated that this member may be formed in any of a variety of different shapes.

Figure 14:
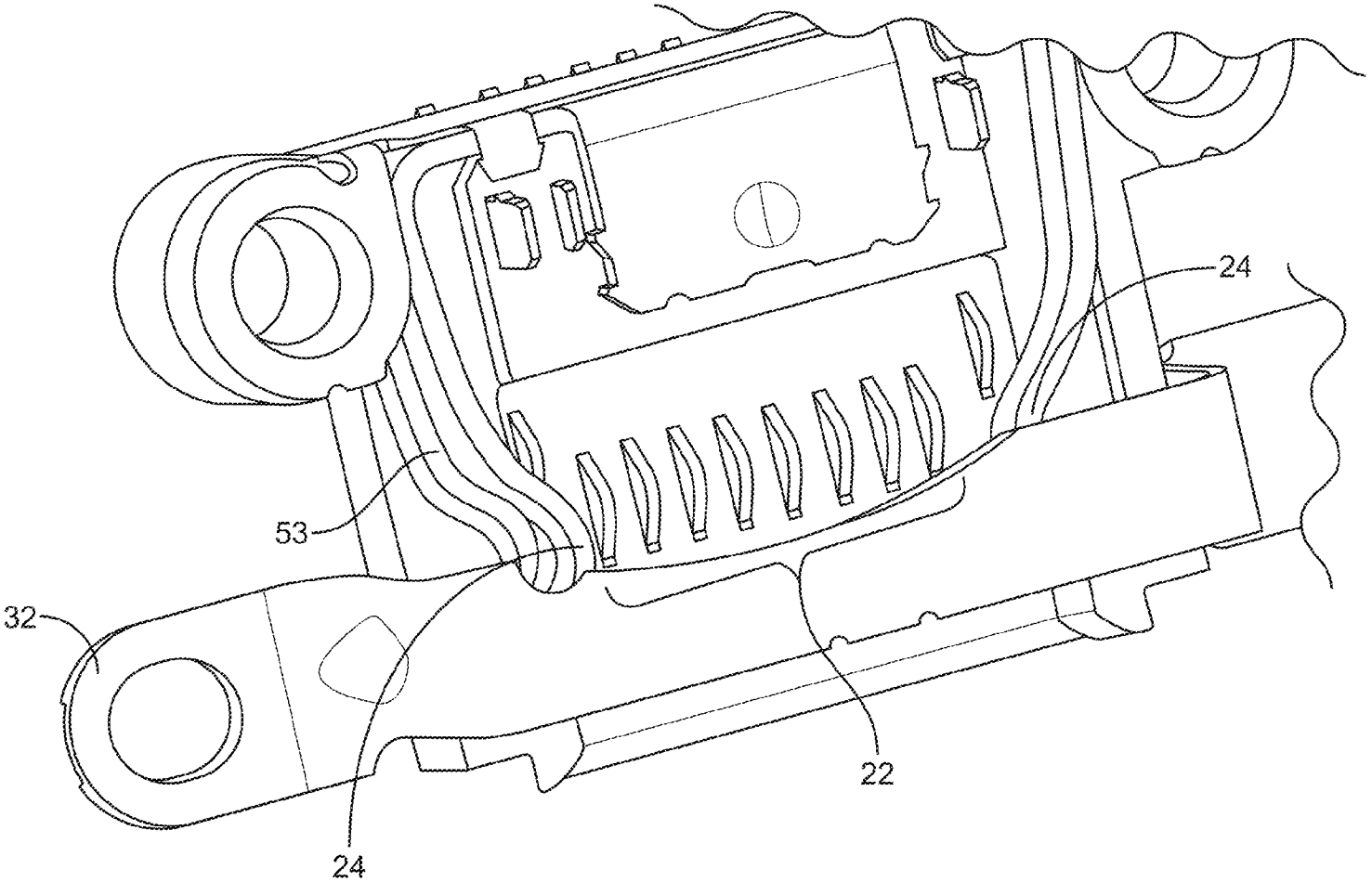

FIG. 14 illustrates an alternative embodiment in which the backup spring comprises a complementary spring arm 53 similar to that of the resilient spring arms 26. The complementary spring arm 53 is shown on one side of a respective spring arm 26 for convenience of illustration, although a complementary spring arm 53 may be included outside of each of the spring arms 26. Utilizing a complementary spring arm 53 as a backup spring is advantageous since the complementary spring arm 53 conforms to the shape of the outside surface of an associated spring arm 26 for contacting the spring arms along a length or along multiple points on the outward facing surface. This may further distribute the forces along the length of the spring arm 26 and help to further prolong the useful life and reduce stress points within the spring arms 24. In such embodiments, the complementary spring arm 53 may be formed as part of the same bracket that forms the spring arm retention features 24, or alternatively may be formed from one or both of the brackets or another suitable component. In this embodiment, as in other embodiments, the contact between the complementary spring arm 53 and spring arms 26 involves metal-to-metal contact. To reduce any wear and tear on the components as well as to reduce the potential formation of metal dust from such contact, a suitable lubricant, such as PTFE and molybdenum grease, may be used between the complementary spring arm 53 and associated spring arms 26. Additionally, various lubricants may be used in any of the embodiments described herein where metal-to-metal contact between components may occur.

FIGS. 15A-16C illustrate another embodiment using a lubricating member 51 adjacent the spring arms to release lubricant to the spring arm retention feature interface. The lubricating member 51 may also be used as a backup spring, similar to that of the elastomeric cylinder 50 described above. In some embodiments, the lubricating members 51 are replaceable within the receptacle through corresponding holes within the housing 30 (indicated by the arrows in FIG. 15B). This feature is advantageous as the lubricating members 51 can be easily removed and replaced with another elastomeric lubricating member 51 as needed to replace worn components periodically over time or as the supply of lubricant therein become exhausted over time. This aspect may also be used to adjust the stress or retention force when the lubricating member 51 also acts as a stress-reducing member or provide for increased retention force. For example, in certain applications where a greater retention force is desired, the lubricating member 51 could be easily replaced with lubricating member 51 having a greater spring force or with lubricating member 51 having differing dimensions without disassembling the housing. In some embodiments, the removable lubricating members 51 are configured with a flange or head portion 51*a* and a shaft 51*b* extending a distance away from the head, the head typically having a greater diameter than the shaft. This configuration is advantageous in that when the lubricating members 51 are inserted into corresponding holes in the housing 30, the flange or head portion 51*a* of each is received within a countersink or recess of the corresponding hole so as to seal each hole. The head portion 51*a* and shaft 51*b* may be made from differing materials or made from the same elastomeric material which allows for a seal between the head 51*a* and the housing 51*b*. It is appreciated that the above described aspect regarding positioning and replacement of the lubricating member 51 through the receptacle housing also apply to an elastomeric cylinder 50 used as backup spring, as described herein.

Figure 15B:
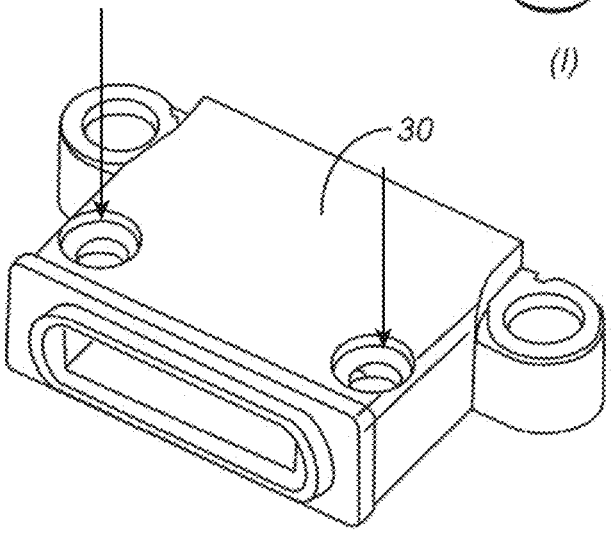

When the retention mechanism includes a lubricating member 51, such as in FIGS. 15A-15C, contact of the resilient spring arms with lubricating member 51 releases lubricant onto the resilient arms 24 so as to lubricate engage surfaces of the retention mechanism. Pressure of the resilient arms 24 against the lubricating members 51 causes lubricant, whether a liquid, paste or powder, to be released from the lubricating member lubricating member 51 onto the spring arms 26 onto an interface of retaining features 24. When contacted, the lubricating members 51 may also act as backup springs countering the force applied by the connector tab 44 and transfers this force along the bracket 34. As seen here, a lubricating member 51 is included on the outside of each of a pair of spring arms. Using opposing spring arms, each having a lubricating member, is advantageous as this lubricates each side to maintain a lubricated state and further distributes the stresses to provide a more uniform retention force in the mated configuration. Generally, the force of the lubricating members 51 exerted inward against the outer facing surface of the resilient arms is proportional to the outward distance by which the lubricating member is displaced. This aspect also provides a consistent pressure against the respective lubricating member 51 in each cycle of use so that lubricant is released in a consistent manner. In a configuration using lubricating members as backup springs, since each lubricating member is only contacted during mid-insertion, such that there is a gap when the connector is fully mated or fully separated, the lubricant is only released during insertion or retraction of the connector plug from the connector receptacle.

Figure 16A:
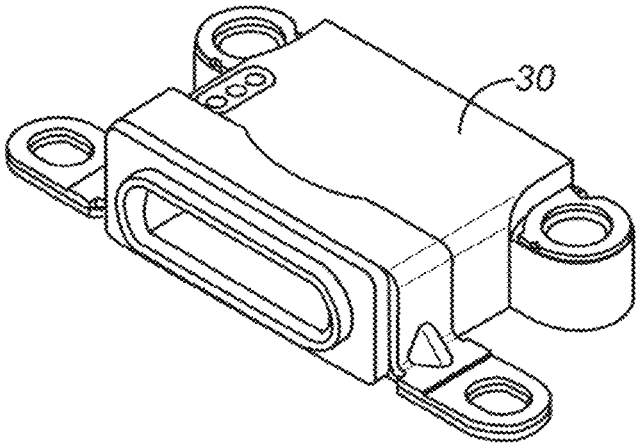
FIGS. 16A-16C illustrate an example connector receptacle assemblies.
Figure 16B:
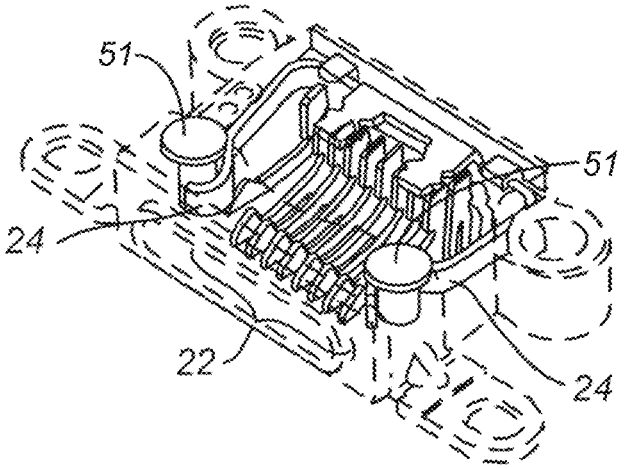
Figure 16C:
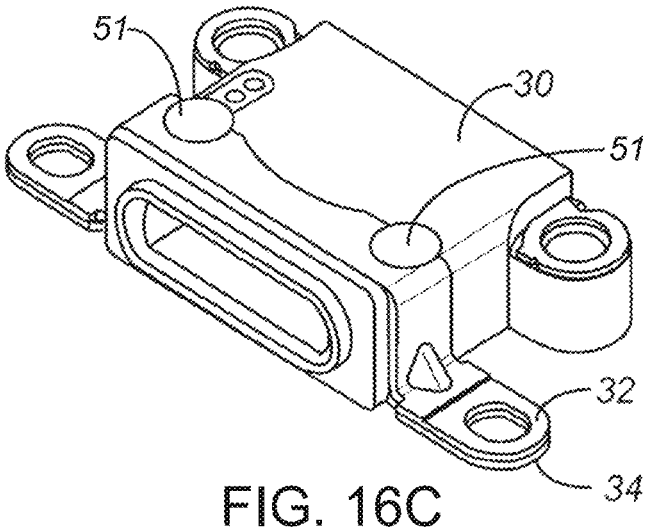

As shown in FIGS. 16B and 16C, an upper bracket 32 (such as shown in FIG. 16A) may be modified to allow access to the holes in the housing 30 for insertion of the backup spring, such as the elastomeric cylinders 50 or lubricating member 51. As seen in FIG. 16B, when the lubricating members 51 are inserted within the holes, the shaft 51*b* extends alongside an outer facing surface of each of the spring arm retention features 24 of the spring arms 26 thereby allowing for improved retention capabilities and fatigue strength as described previously. As seen in FIG. 16C, the backup springs remain accessible even when coupled within a device by upper and lower brackets 32, 34 so as to allow for adjustment of the retention force by removal and/or replacement of the backup springs.

Figure 17B:
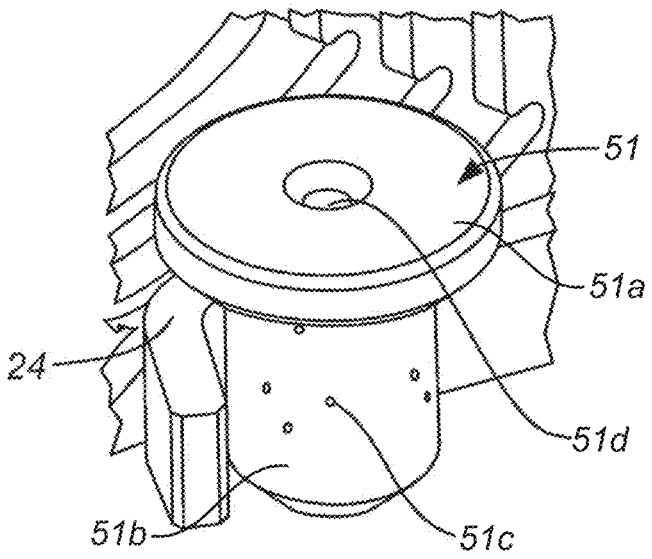
Figure 18:
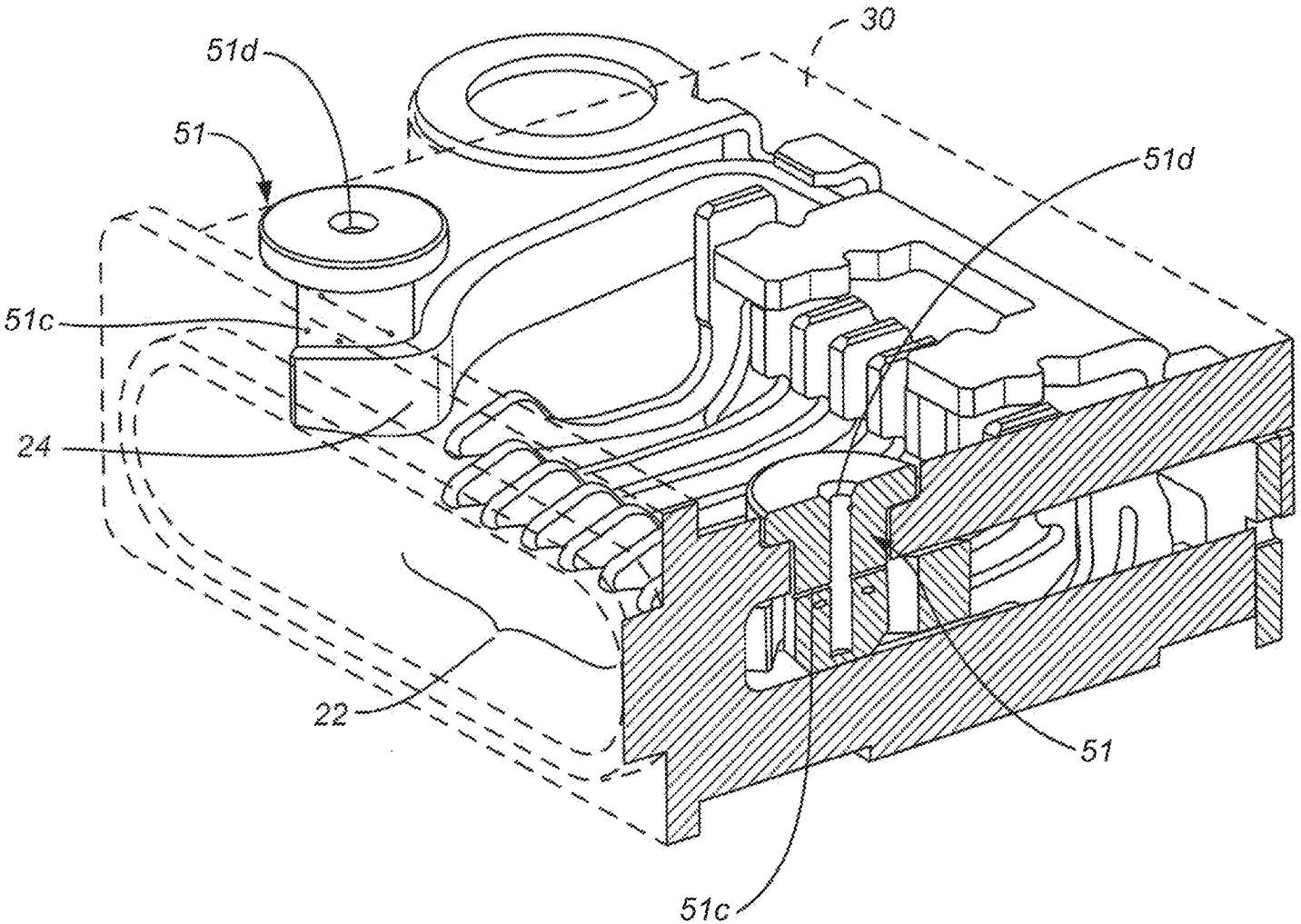
FIG. 18 illustrates a replaceable self-lubricating backup spring in an example connector receptacle assembly.

FIGS. 17A-17B illustrate additional aspects associated with use of self-lubricating backup springs, such as those described above. The lubricating members 51 may be positioned outside the pair of resilient arm retention features 24 and lubricating member 51 fabricated from an elastomer designed to slowly release either a liquid or solid lubricant onto the adjacent components to prolong the lubricated life of the parts. The lubricating member 51 may comprise an inherently porous or sponge-like material that is pre-infused with a desired lubricant so as to release the lubricant upon contact or when pressure is applied. The lubricating member 51 may also include an internal reservoir containing a lubricant to be released through small channels or pores 39 in fluid communication with the reservoir that slowly release particles as the lubricating member 51 is engaged, such as by contact or applied pressure, with each cycle of use. As shown in FIG. 17B, each lubricating member 51 may include a central reservoir 51*d*, such as shown in FIG. 18. The reservoir may be accessible via an access opening to allow for re-filling of the reservoir or the reservoir or could be sealed and the lubricating members 51 switched out when the lubricant in the reservoir is exhausted. FIG. 18 illustrates an example of the components in FIGS. 17A-17B as positioned within an example receptacle housing, the housing including access holes to allow insertion of the lubricating members 51 into the connector receptacle or replacement of the lubricating members 51 periodically over the lifetime of the device.

Figure 19:
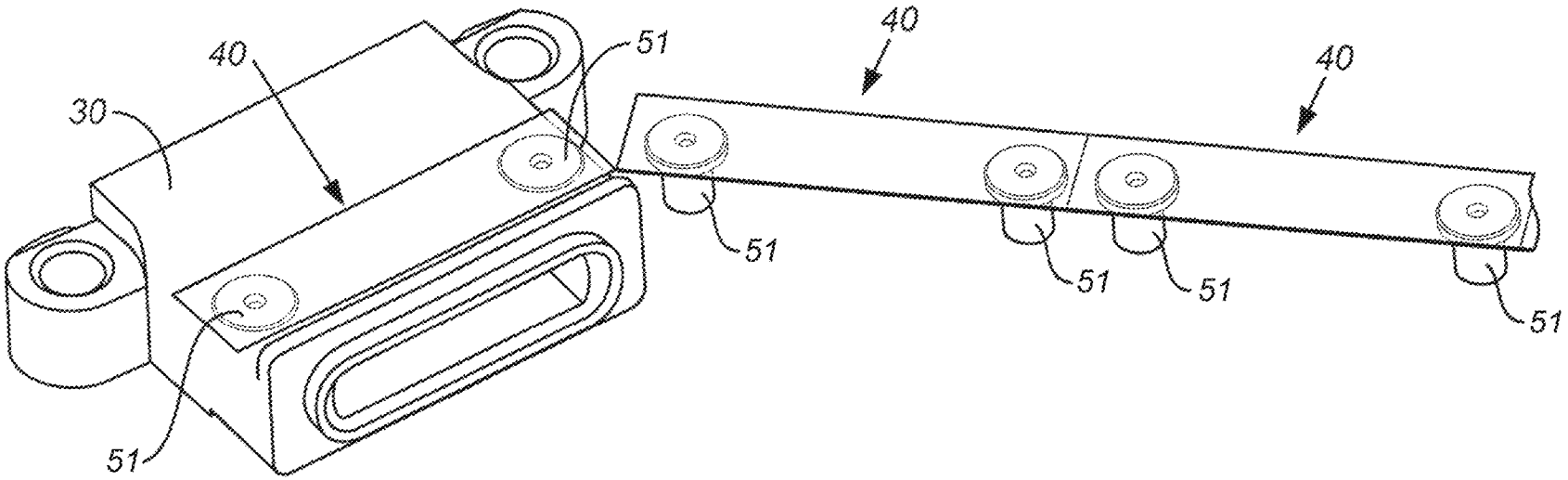
FIG. 19 shows pre-fabricated strips, each strip having a pair of lubricating members for use with a connector receptacle assembly.

FIG. 19 illustrates strips 40 having lubricating members 51 thereon to allow for quick and easy assembly of the lubricating members 51 into the connector receptacle housing 30 and to further allow for easy replacement of lubricating members 51 as desired. In this embodiment, each strip 40 includes a pair of lubricating members 51 disposed thereon and positioned for dual insertion of the lubricating members 51 into the corresponding holes of the receptacle housing 30. The strip may be fabricated from a thin plastic or any material suitable for use with the connector assembly. The pair of lubricating members may be fixedly attached or removably attached to the strip, such as with an adhesive, snap-fit, or other suitable attachment means. In one aspect, the lubricating members 51 each have a head and a shaft, the head being wider than the shaft and the top surface of the head being attached to a bottom surface of the strip. The strips 40 may be included in a pre-fabricated roll, each strip being detachable from the roll, or the strips 40 may be pre-fabricated as separate strips. In some embodiments, the strip 40 may also be used to seal the access opening of the reservoirs in the lubricating members 51. Although the strip 40 may be configured to peel away after insertion, the strip 40 may be configured to remain attached to the lubricating member 51 to facilitate easy removal of the lubricating member 51 for replacement. It is appreciated that this feature may also apply to various other embodiments of the backup spring, such as the elastomeric cylinders 50 described previously.

Figure 21A:
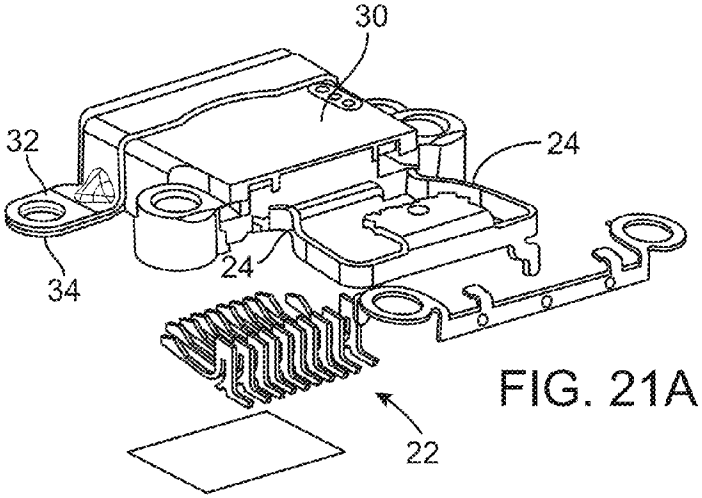
FIGS. 20A-22 show an example electrical connector receptacle.
Figure 21B:
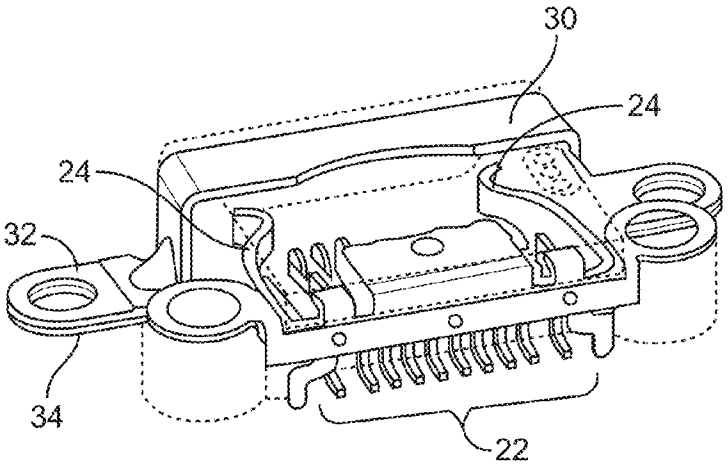
Figure 20A:
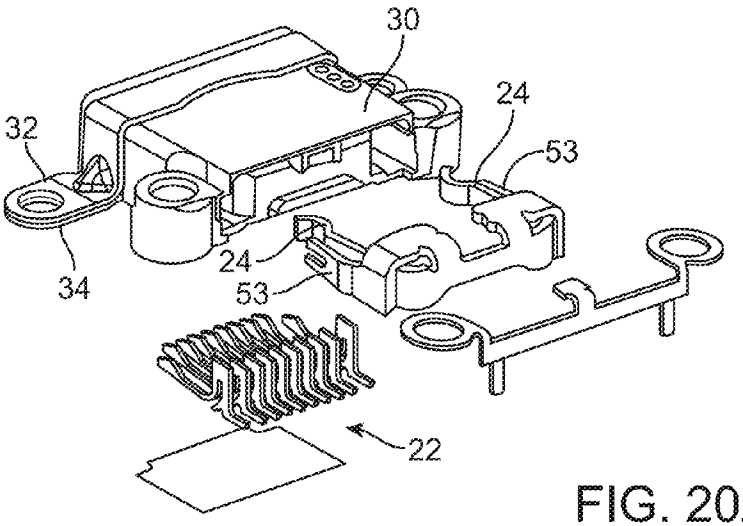
Figure 20B:
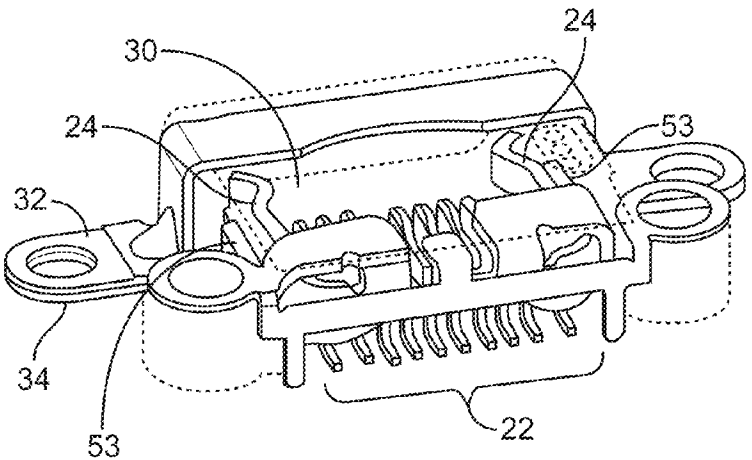

FIGS. 20A-20B illustrate another embodiment in which the backup spring is defined as complementary spring arms 53 within a dual spring, where two opposing complementary spring arms 53 are formed from the same component. In some embodiments, the dual backup spring extends from a base of the bracket defining the spring arms 26 and associated spring retention features 24 such that the backup springs are integrated with the spring arm retention feature bracket (compare to a typical spring arm retention feature bracket shown in FIGS. 21A-21B). Typically, the complementary spring arms 53 extend only along a portion of the spring arm retention feature 24 and are not necessarily complementary or conforming in shape, such as those shown in the embodiment in FIG. 14.

Figure 22:
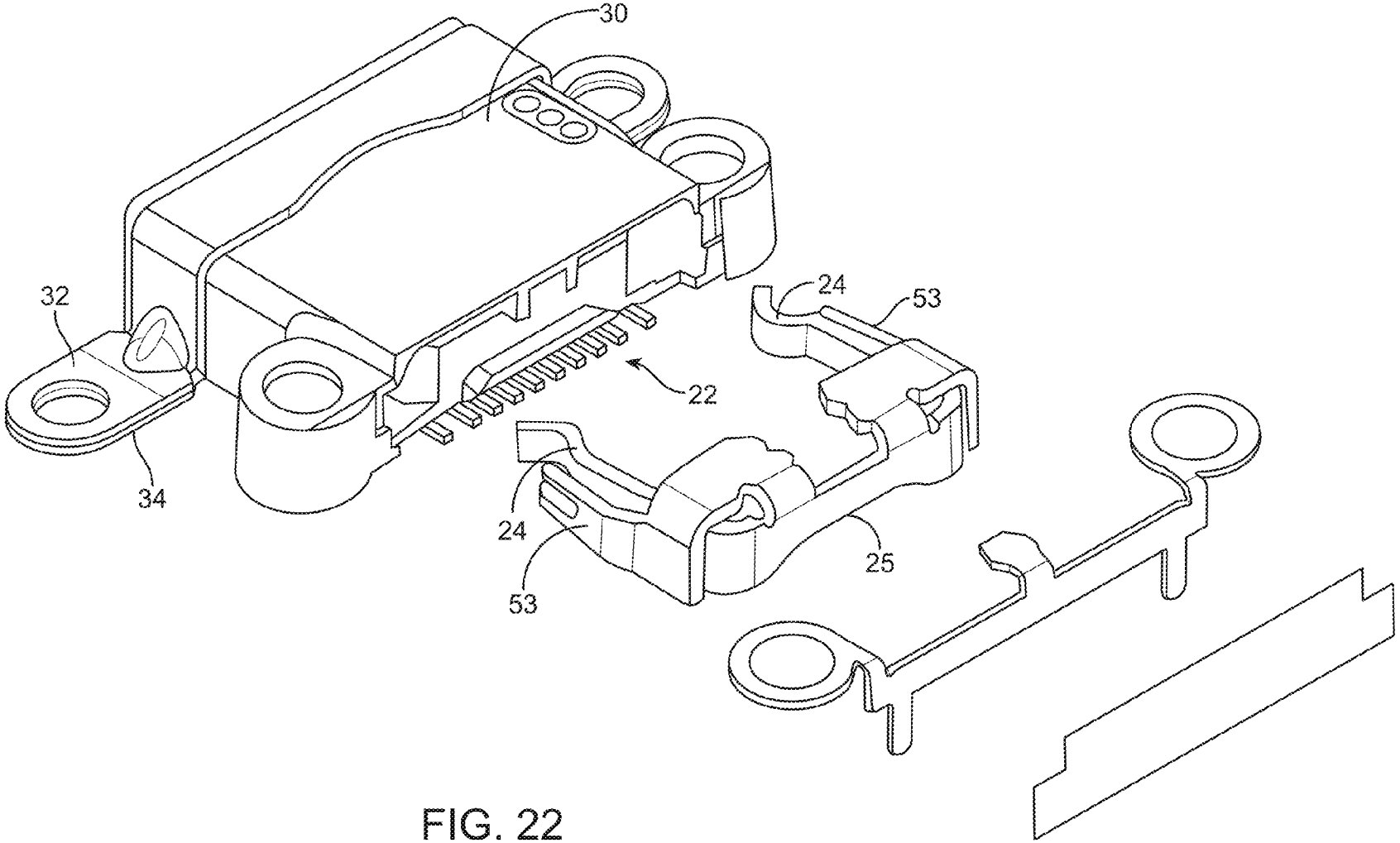

In one aspect, complementary spring arms 53 of relatively short length may have improved strength when compared to the spring arm 26 of substantially greater length. This embodiment can be further understood by referring to FIG. 22 which illustrates the bracket having two complementary spring arms 53 attached to the base 25 of the bracket and extending alongside an outer facing surface of each spring arms 26. This configuration is advantageous as it allows for the improved retaining capabilities and fatigue strength while still allowing space around outside the curved portion of the spring arm retention feature 24 for other components (such as one or more additional backup springs in this area). Forming opposing complementary spring arms 53 as part of the same component is further advantageous as it splits the spring load across the complementary spring arms 53 improving both the insertion and retraction forces, reducing the stress load on the components and improving fatigue life of the connector assembly. Stress analysis tests performed on example prototypes of this design fabricated from stainless steel having a Young's modulus of 186000 $N/mm^2$ and a Yield stress of 1300 $N/mm^2$ indicated a displacement of 0.565 mm, an applied force of 14.1 N and a stress peak of 1400 $N/mm^2$.

Figure 23:
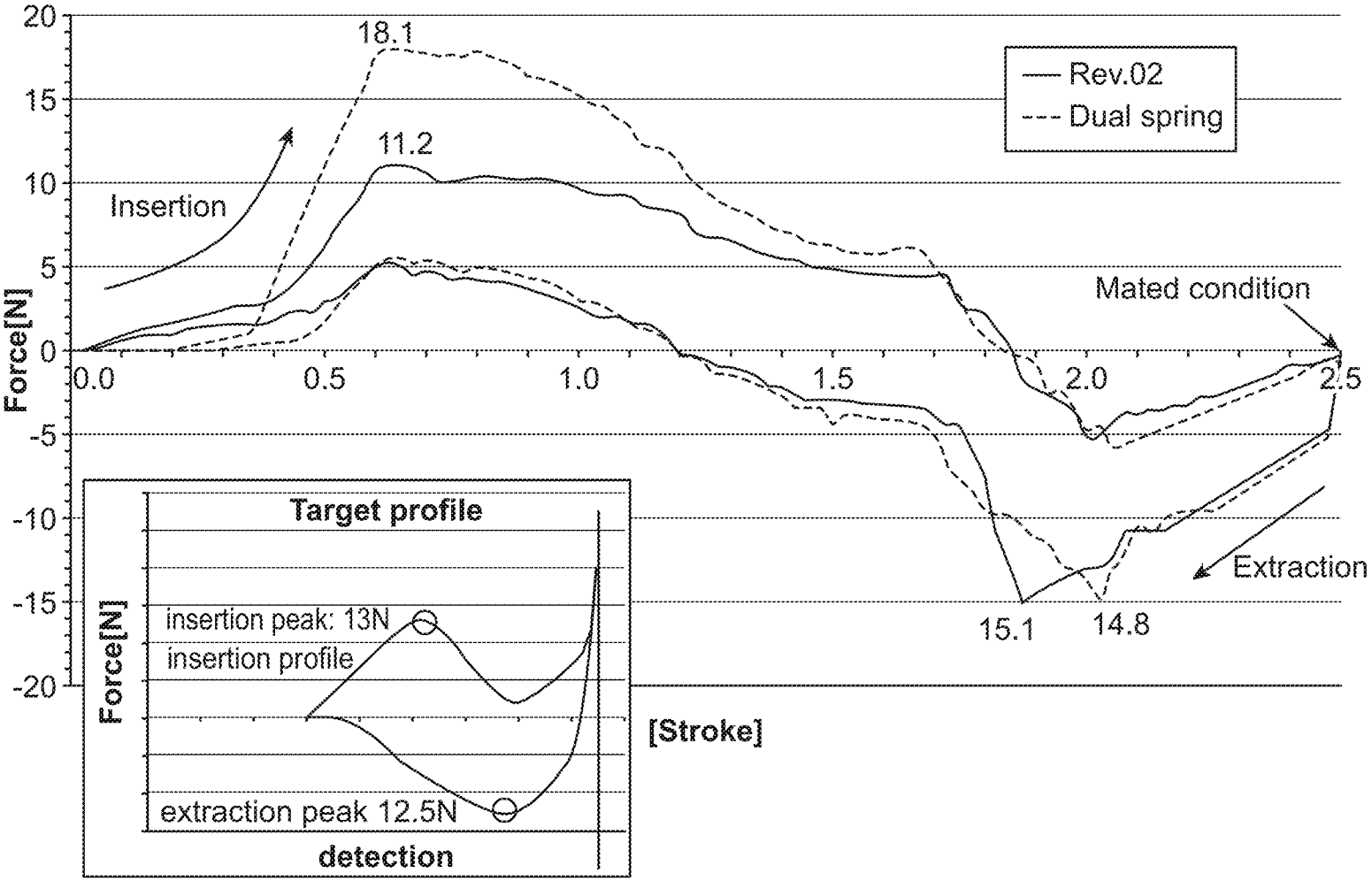
FIG. 23 shows an insertion and retraction force profile as seen in the electrical connector shown in FIG. 19.

FIG. 23 shows a graph of insertion and retraction forces that illustrates testing results of a dual spring embodiment as compared to a single spring embodiment. The graph indicates a reduction in the peak insertion force from 18.1 N (achieved in prior designs) to 11.2 N with the dual backup spring design.

As can be seen in the insert graph of FIG. 23, the insertion and extraction profile provided by the dual backup spring design is closer to that of the desired insertion and retraction forces shown in the target profile. Table 2 below provides mechanical characteristics obtained in a finite element analysis of a mechanism using the dual spring design as compared against alternative designs without the dual backup spring.

TABLE 2

Comparison of Mechanical Characteristics

| | Dual Spring type | Rev 02 modified | Rev 02 | Rev 15 | Target |
|---|---|---|---|---|---|
| Displacement (mm) | 0.565 | 0.52 | 0.52 | 0.645 | — |
| Normal Force (N) | 14.1 | 21.7 | 21.7 | 9.6 | — |
| Stress Peak ($N/mm^2$) | 1400 | 2500 | 2500 | 2022 | — |
| Insertion Force (N) | 11.2 | (18.1) | 18.1 | — | 13 |
| Extraction Force (N) | 15.1 | (1438) | 14.8 | — | 12.5 |

Although in various described embodiments, the complementary spring arms 53 are formed from the same component and integrated with the spring arm retention feature bracket, it is appreciated that the dual backup spring may also be formed from a component that is separate from the spring arm retention feature bracket and maintain many of the advantages described above. Additionally, it is appreciated that this embodiment may be used in conjunction with any of the backup spring and/or lubricating members described herein.

Figure 24:
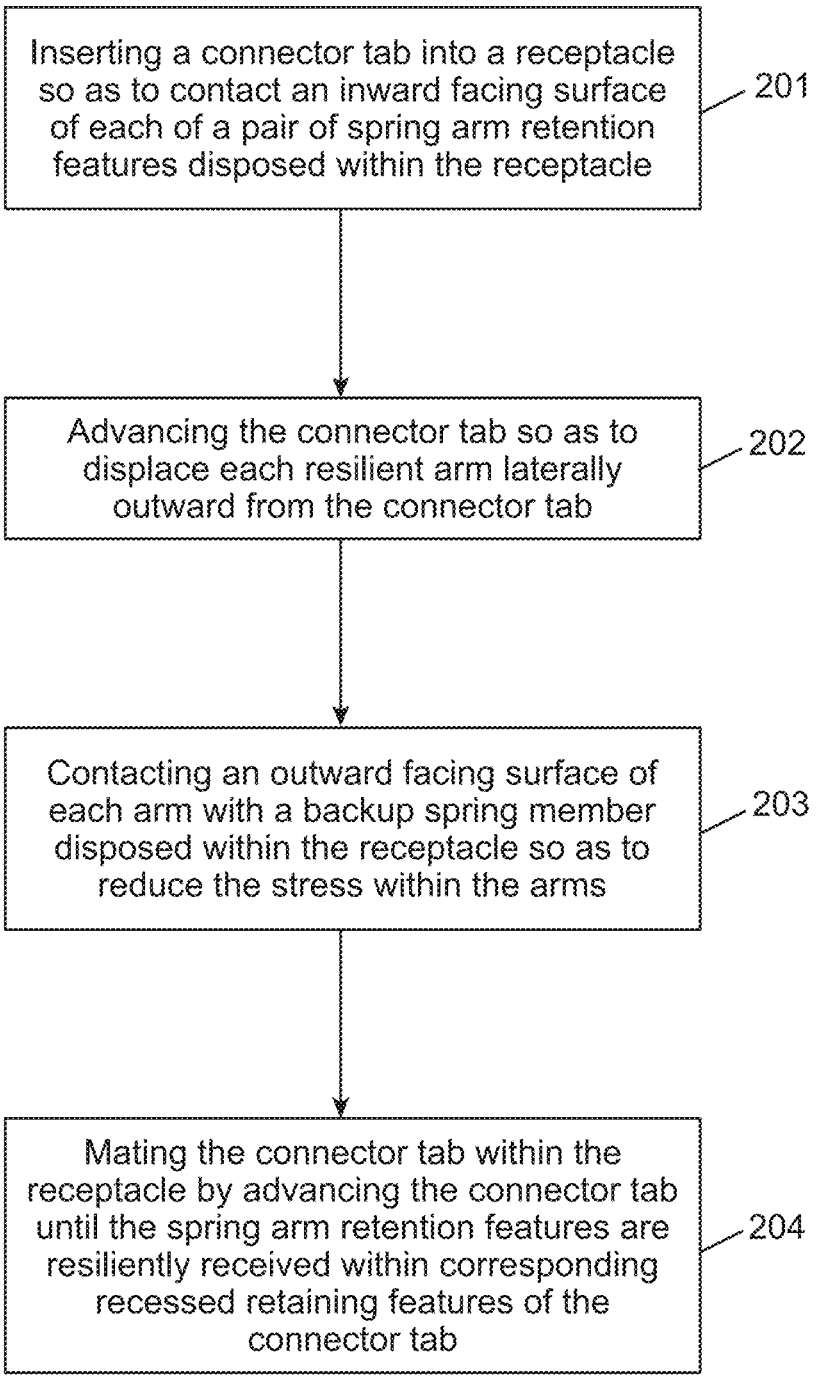
FIG. 24 shows an example method of use of a retention latch device.

FIG. 24 depicts methods for retaining an inserted component within a receptacle in accordance with some embodiments. An example method for retaining a tab within a receptacle in an electrical connector assembly includes: inserting a connector tab into the receptacle so as to contact an inward facing surface of each of a pair of spring arm retention features disposed within the receptacle 201; advancing the connector tab so as to displace each resilient arm laterally outward from an insertion axis along which the connector tab is inserted 202; contacting an outward facing surface of each arm with a corresponding backup spring member disposed within the receptacle 203; exerting a force with the backup spring member so as to reduce the stress within the arms; and mating the connector tab within the receptacle by advancing the connector tab until the spring arm retention features are resiliently received within corresponding recessed retaining features of the connector tab 204.

Figure 25:
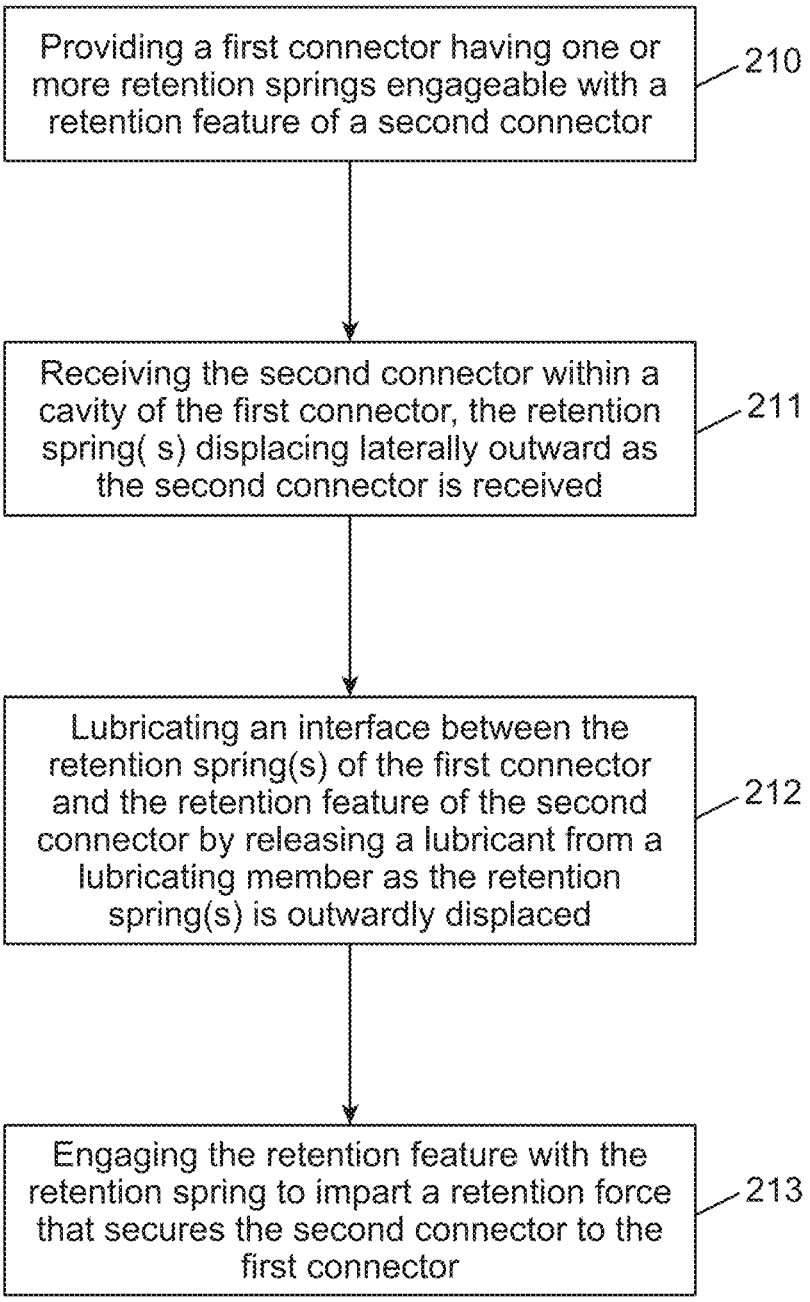
FIG. 25 shows an example method of retaining a connection in an electrical connector.

FIG. 25 depicts an example method for retaining an inserted component while maintaining a lubricated state of the retention components. The example method includes: providing a first connector having one or more retention springs engageable with a retention feature of a second connector 210; receiving the second connector within a cavity of the first connector, the retention spring(s) displacing laterally outward as the second connector is received 211; lubricating an interface between the retention spring(s) of the first connector and the retention feature of the second connector by releasing a lubricant from a lubricating member onto the retention spring(s) during outward displacement 212; and engaging the retention feature with the retention spring to impart a retention force that secures the second connector to the first connector 213.

In some embodiments, the backup springs are attached to the spring arms 26 and positioned outside each spring arm 26 so as to provide a second contact surface S2 for the spring arm 26 against an adjacent side wall of the housing 30 before the tab 44 is inserted, there being a gap between the second contact surface S2 and the receptacle side wall before insertion of tab 44. Inserting the tab 44 displaces the resilient arms 24 laterally outward closing the gap to contact the sidewall of the receptacle housing 30. In some embodiments, the backup springs may be configured or dimensioned so that a gap forms as the resilient arms 24 are received within the recessed features 14 in the mated configuration (the gap being smaller than the gap prior to insertion) so that the component acts as a backup spring to reduce stresses during insertion and retraction of the tab but does not otherwise alter the retention force provided by the spring arms 26 in the mated configuration. Alternatively, the a component acting as a backup springs may remain in contact with the sidewall of the housing 30 when in the fully mated configuration so that the spring force of the displaced backup spring provide an additional force that increases the normal force on the connector tab through the retention feature 24.

In addition, the backup springs may provide additional functions relating to the electrical path through the spring arms 26 to which the backup springs are attached. For example, if the backup springs are fabricated from an electrically conductive material, the backup springs may provide an additional ground path for the ground ring or may be used to provide an indication that the connector tab 44 is mated within the receptacle. Alternatively, the backup springs may be fabricated from a material having electrically insulative properties, as found in many elastomeric materials, which may minimize or eliminate losses of the electrical path through the spring arms 26 from touching the receptacle housing 30 or an associated component 31. This aspect may be advantageous in embodiments utilizing an electrical path through the spring arms 26 and may be used to improve the signal integrity of the mating interface between the retention features. For example, some embodiments may utilize the electrical path between the metal ground ring of the connector tab and the spring arms of the connector receptacle, when in the mated configuration, as a ground path or as an indication that mating is complete.

In some embodiments, compression springs 58 may be used as backup springs and positioned on the spring arms 26 at or near the point of increased stress during cycling so as to act as a stress-reducing backup spring or secondary spring, the force provided by the compression spring as it is compressed countering the insertion or retraction forces on the spring arms 26 during cycling. The compression springs 58 may also be used to change the normal force on the connector tab during insertion, retraction or when mated within the connector receptacle, so as to provide the desired insertion/extraction profile or retention force without requiring alteration of the spring arm components.

Figure 26A:
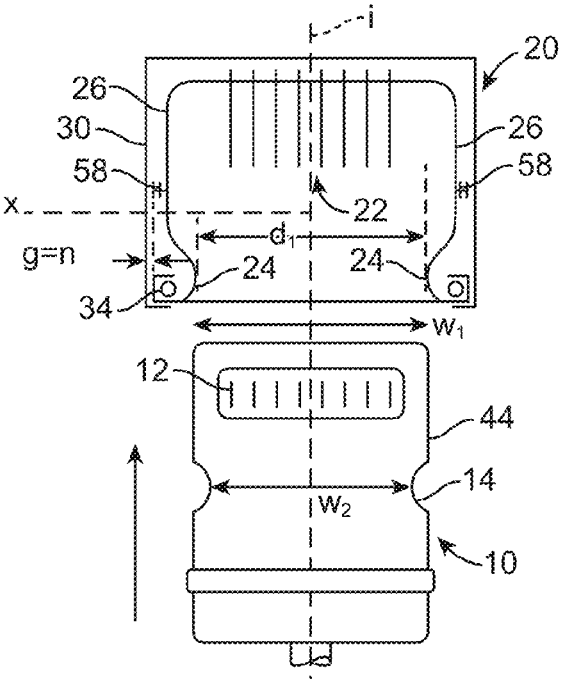
FIGS. 26A-26C illustrate sequential cross-sections along an insertion plane showing the insertion of a connector plug into an example connector receptacle.
Figure 26B:
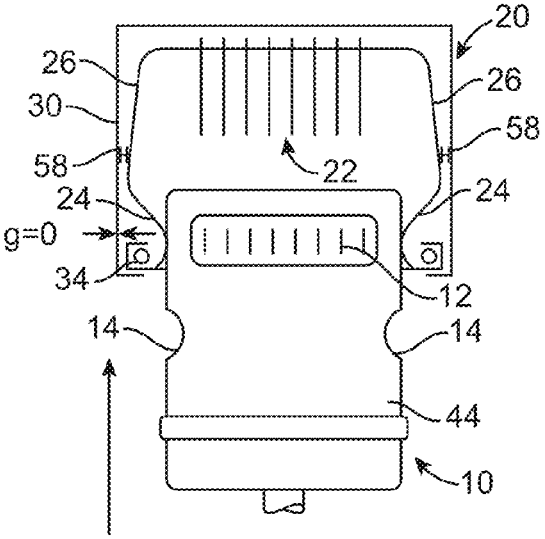
Figure 26C:
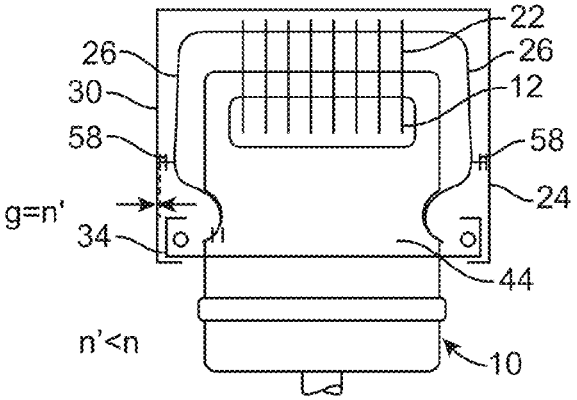

The use of an attached backup spring can be further understood by referring to FIGS. 26A-26C, which sequentially illustrate the insertion of a connector tab into a receptacle having resilient spring arms 26 with attached compression springs 58 extending laterally outward from the insertion axis (i). In FIG. 26A, a connector assembly having a retention mechanism with compression springs 58, such as shown in FIG. 3D, is shown prior to insertion of the connector plug 10. As can be seen, the width of the front portion of the tab 44 (w1) is wider than the distance between the curved portions of the resilient arms 24 (d1) of the receptacle so that insertion of the tab 44 displaces the spring arms 24 laterally outward toward the compression springs. As insertion of the tab 44 laterally displaces the resilient arms 24, the compression spring on each arm contacts an adjacent receptacle housing 30 or associated component, thereby compressing the compression spring to exert an opposing form on the respective spring arm thereby reducing the stresses therein. It can also be seen that the width (w2) between the recessed retention features 14 is greater than the distance d1, so that when the plug 10 and receptacle 20 are in the mated configuration, the spring arms 24 exert a force on the tab 44 toward the insertion axis (i). In the illustrated embodiment, the compression springs 58 are configured so that there is a relatively small gap (g) between the second contact surface of the compression springs 58 and the receptacle housing component 30. The magnitude of the gap in this configuration (n) may is relatively small, such as a 0.1 mm to 6 mm gap.

FIG. 26B illustrates insertion of the leading portion of the tab 44 into the receptacle 20 between the spring arms 24, which displaces each of the spring arms 24 laterally outward away from the insertion axis (i) and the secondary contact surface of the compression springs 58 against the receptacle housing component 30. The compression springs 58 counters the force applied by the tab 44 exerts an opposing force, the magnitude of which is determined by the amount of displacement of the compression spring 58 and the associated spring constant. In an example embodiment, a compression springs 58 is attached on the outside of each of a pair of spring arms. Using opposing spring arms, each having a backup spring, is advantageous as this further distributes the stresses as well as providing a more uniform retention force in the mated configuration. Additionally, utilizing a pair of spring arms 26 with backup springs configured so that the forces applied to such springs are in opposing direction is further advantageous as these opposing forces are can be resolved within the U-shaped metal bracket comprising the resilient arms and within the upper and/or lower bracket comprising the backup springs. Generally, the force of the compression springs 58 exerted inward against the outer facing surface of the resilient arms is proportional to the outward distance by which the backup spring is displaced. This aspect helps keep the contacts forces and stresses within the resilient arms below the threshold and/or helps keep the lateral displacement of the resilient arms within a desired range so as to avoid failure or interference with adjacent components.

FIG. 26C illustrates the connector plug 10 fully inserted within the receptacle 20 within the mated configuration, each of the electrical contacts 12 of the connector plug 44 electrically coupled with the electrical contacts 22 of the receptacle 20. As can be seen, the spring arm retention features 24 are engaged within the recessed retention features 14 of the connector tab 44 and the distance between the spring arms is w2 is such that the spring arms are outwardly displaced in the mated configuration so as to provide a retaining force against the sides of the tab 44 to ensure electrical contact, such that the springs arms may also function as a ground path for the ground ring of the connector tab 44. In some embodiments, there may be a gap between each of the compression springs 58 and the adjacent receptacle housing 30 so that the inwardly directed retention force between the spring arm 24 and the tab 44 is proportionally related to the outward displacement of the spring arms 26 in the mated configuration. In such embodiments, the magnitude (n') of the gap in this configuration would be less than the magnitude (n) of the gap before insertion of the tab 44. In some embodiments, the compression springs 58 may be configured so that contact between the compression springs 58 and the resilient arms 24 is maintained in the mated configuration, such that the inwardly directed retention force on the tab 44 is a proportionally related to the displacement and spring constant of each of the compression springs 58 and the spring arms 26. This aspect may be useful in that the retention force may be adjusted by utilizing different brackets 32, 34 rather than modifying the resilient spring arms 24. This may also be useful as this may provide an additional ground path through the brackets to which the compression springs 58 may be connected.

In some embodiments, the backup compression springs 58 are configured to remain compressed in the mated configuration in FIG. 26C, there being no gap between the compression springs 58 and housing 30 (n'=0). This aspect allows for displacement of the compression springs 58 by contacting a secondary contact surface on the backup spring with the receptacle housing 30, or associated attached component, when in the mated configuration so that the compression springs 58 exerts a force on the spring arms directed towards the insertion axis so as to increase the normal force applied to the connector tab by the retaining features 24 at the first contact surface S1, thereby increasing the associated retention force of the connector.

Figure 27A:
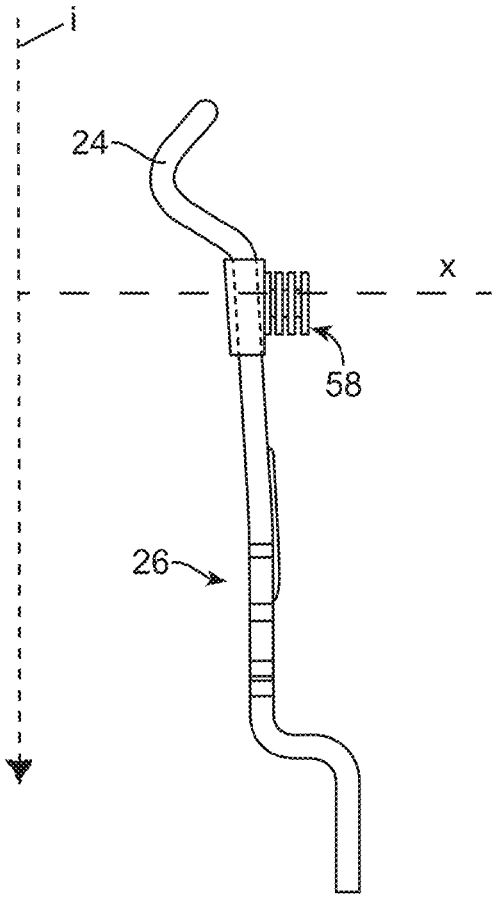
FIGS. 27A-27C show an example backup compression spring attached to a retention spring arm.
Figure 27B:
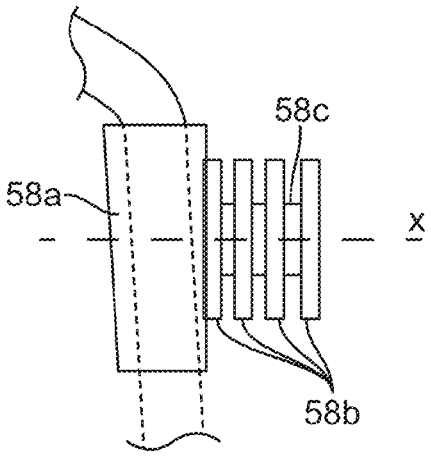
Figure 27C:
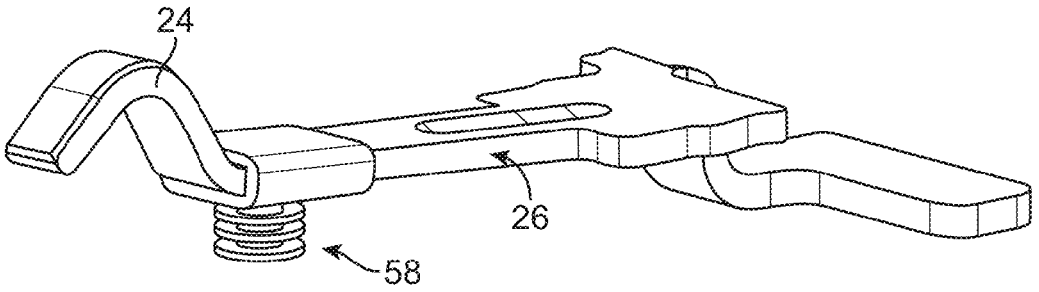

FIGS. 27A-27C depict detail views of an example compression springs 58 mounted on a spring arm 26 as a backup spring or secondary spring, such as in the connector receptacles shown in FIGS. 26A-26C. The compression springs 58 include a coupling portion 58*a* and one or more compressible members 58*b*, shown in this embodiment as a series of circular elastomeric members, although it is appreciated that various differing shapes and combination of elastomeric members could be used in accordance with the invention. The coupling portion 58*a* substantially circumscribes a portion of each spring arm 26 so as to securely attach each compression springs 58 to a respective spring arm 26. In some embodiments, coupling portion 58*a* may be formed by insert molding the compression springs 58 directly onto the spring arm 26, although the compression springs 58 may be attached or mounted to the spring in a variety of ways. Once secured to the spring arm, the compression springs 58 extend laterally outward along lateral axis (x) to a secondary contact surface S2 between the spring arm and the housing of the receptacle. In some embodiments, the coupling 58*a* may be removable, such a slidable sleeve or a snap-fit coupling so as to allow for removable and replacement of the compression springs 58 or interchanging between compression springs having differing spring constants, as desired.

Figure 28A:
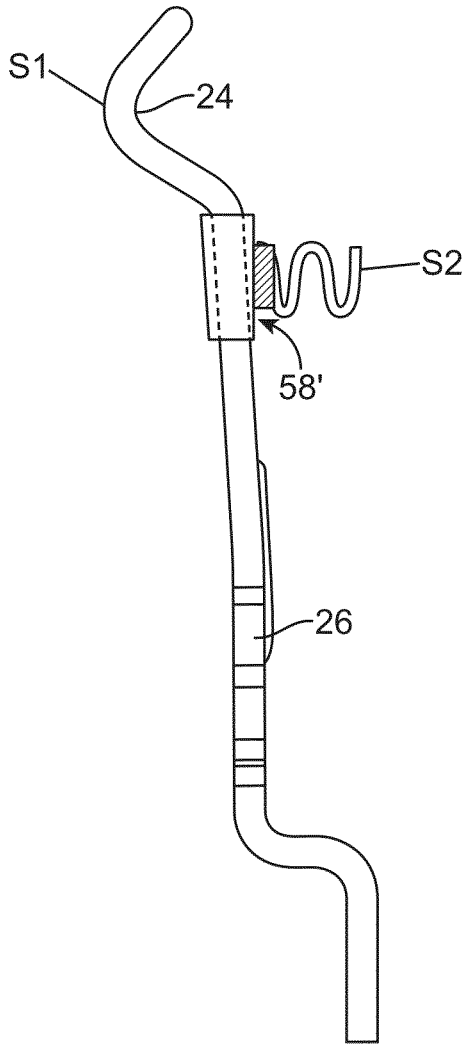
FIGS. 28A-28B show alternative examples of backup springs mounted on retention spring arms.
Figure 28B:
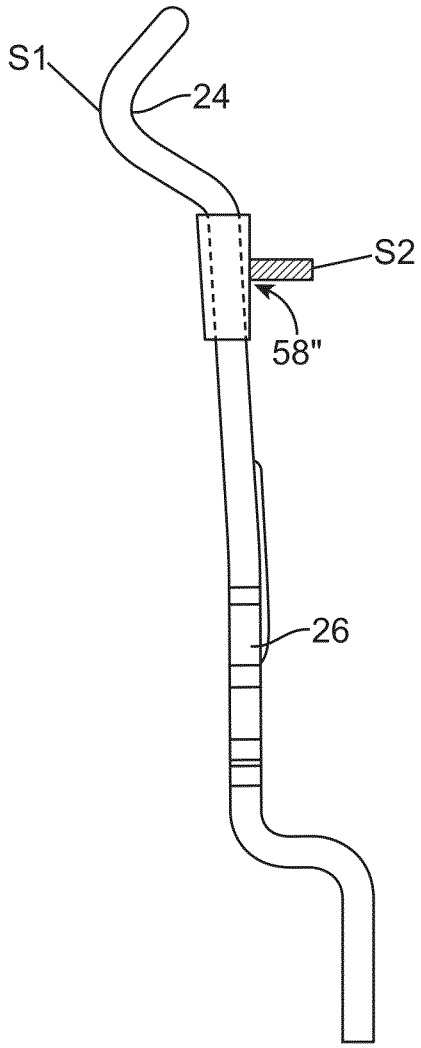

FIGS. 28A-28B illustrate alternative embodiments of compression springs 58 for use as back springs, in which the compression spring 58 may be defined by an undulating member or as member of substantially uniform cross-section fabricated from a compressible material, respectively. Each compression spring 58 is configured to be compressible along lateral axis (x). In some embodiments, the compression springs 58 may include any or all of: an elastomer, a plastic, and a metal as desired to provide various differing material properties to the compression springs 58 as needed for a particular application or to provide a particular force profile.

Figure 29:
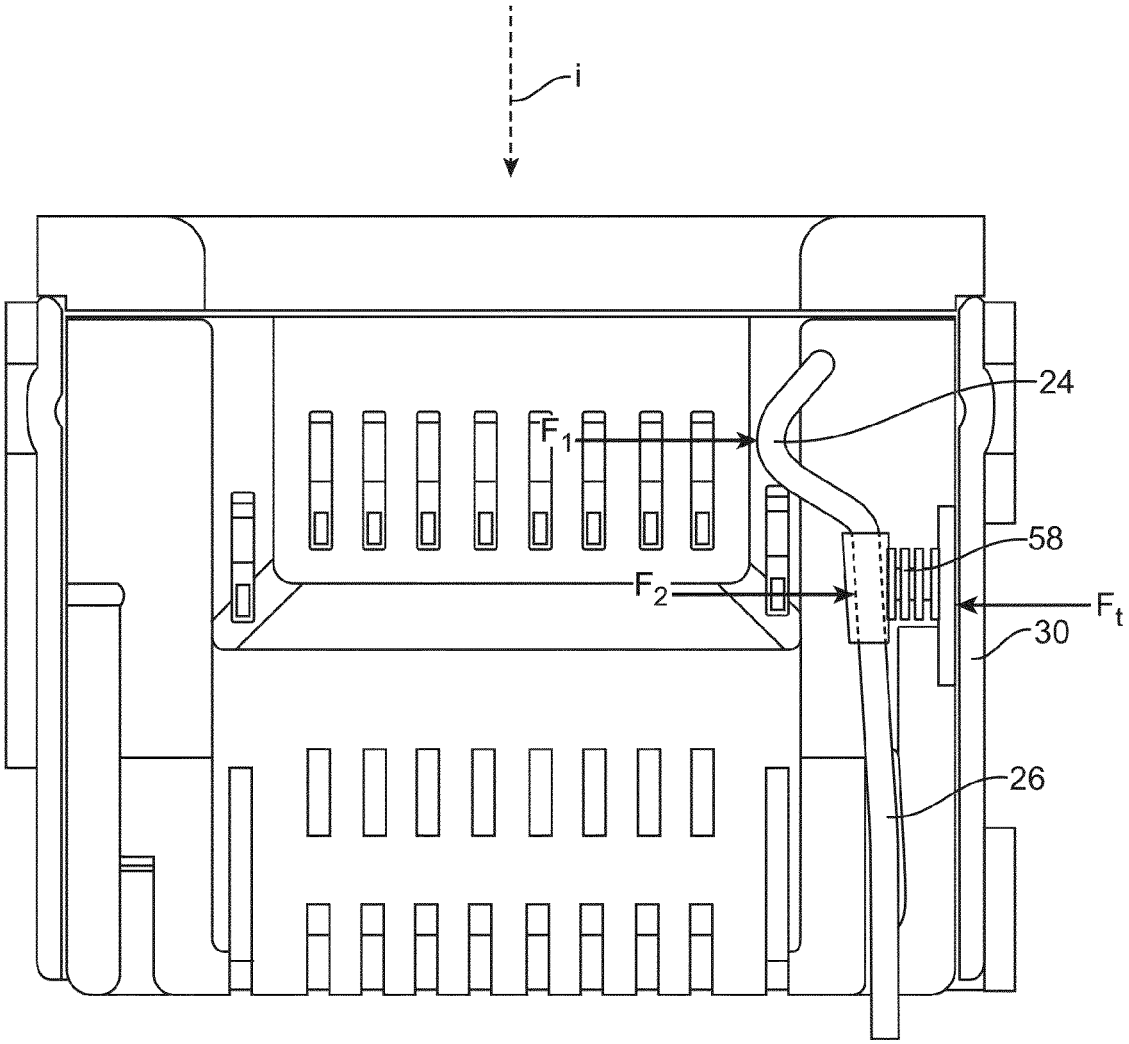
FIG. 29 shows an overhead view of a connector receptacle having the retention spring arms shown in FIG. 27A.

FIG. 29 illustrates an overhead view of the connector receptacle with a retention mechanism having compression springs 58 shown in FIGS. 27A-27C, in which the inwardly curved retaining portion 24 defines a first contact surface S1 and the attached compression springs 58 defines a second contact surface S2. As shown, the total retaining force ($F_t$) provided by the spring arms 26 includes both the retention spring force ($F_1$) at the first contact surface S1 and the backup spring force ($F_2$) of the compression spring 58 exerted at the second contact surface S2.

Figure 30A:
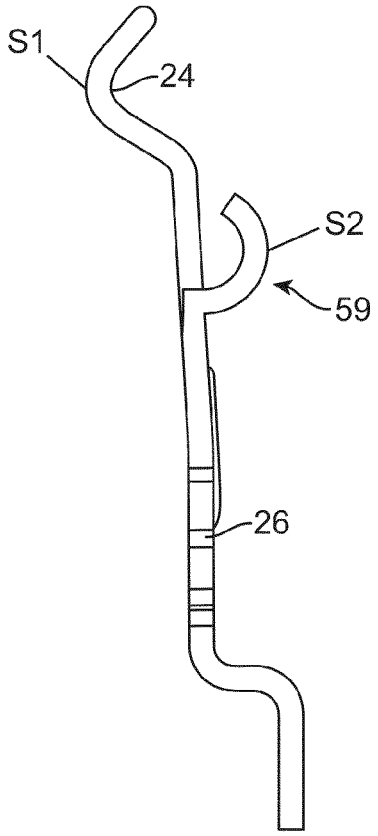
FIGS. 30A-30B show an alternative example backup spring integrally formed with the retention spring arm.
Figure 30B:
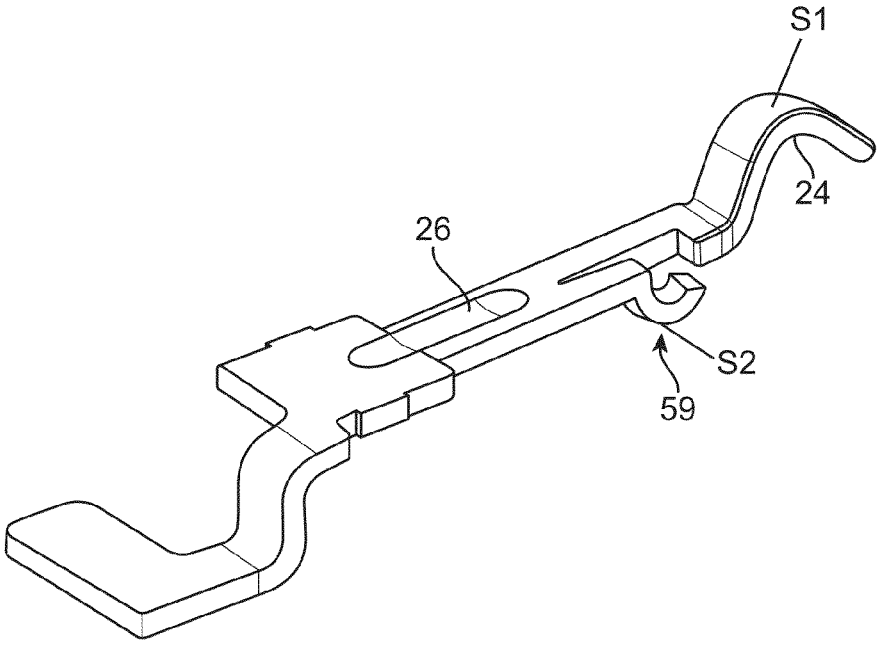

FIGS. 30A-30B illustrates an alternative embodiment, in which the retention mechanism includes a bent tab portion 59 of the retention spring arm 26 that curves outwardly to form a backup or secondary spring. The curved tab 59 may be fabricated in conjunction with the spring arm 26 such that the backup springs 26 are integral with the curved tabs 59 and are fabricated from a common material, such as stainless steel. The curved tab 59 may be formed by stamping a pre-formed spring arm so as to bend a portion of the spring arm outward to form the curved tabs 59 extending laterally outward away from the insertion axis and associated secondary contact surface S2. In some embodiments, the curved tabs 59 are formed by a portion of the spring arm having a width about half that of the entire spring arm width. In various embodiments, the curved tabs 59 are formed to each have a spring rate equal to or greater than that of the associated spring arm in which they are formed, although it is appreciated that the backup spring can be formed according to various configurations and spring constants.

Figure 31:
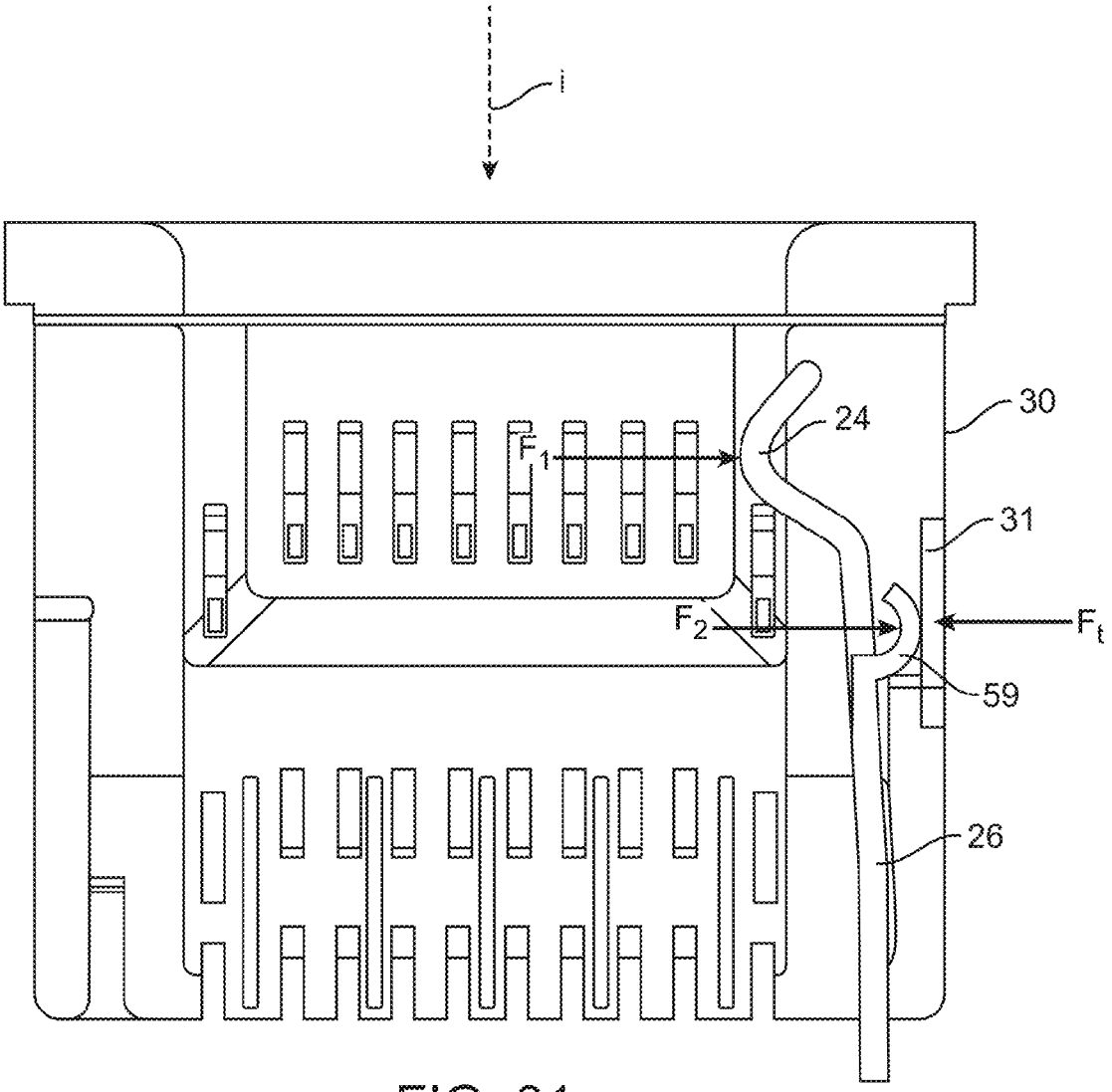
FIG. 31 shows an overhead view of a connector receptacle having the retention spring arms shown in FIG. 30A-30B.

FIG. 31 illustrates an overhead view of a connector receptacle with a retention mechanism having the curved tabs 59 shown in FIGS. 30A-30B. As shown, the total retaining force ($F_t$) provided by the spring arms 26 includes both the retention spring force ($F_1$) at the first contact surface S1 and the backup spring force ($F_2$) of the curved tab 59 exerted at the second contact surface S2. The receptacle housing 30 may include an associated component 31, such as a block or elongate member, against which the second contact surface S2 of the curved tabs 59 engages when outwardly displace during insertion of the tab within the receptacle. The block 31 may allow for backup springs having smaller dimensions as it allows the second contact surface S2 to engage the receptacle housing at smaller outward displacements of the spring arms 26.

Figure 32:
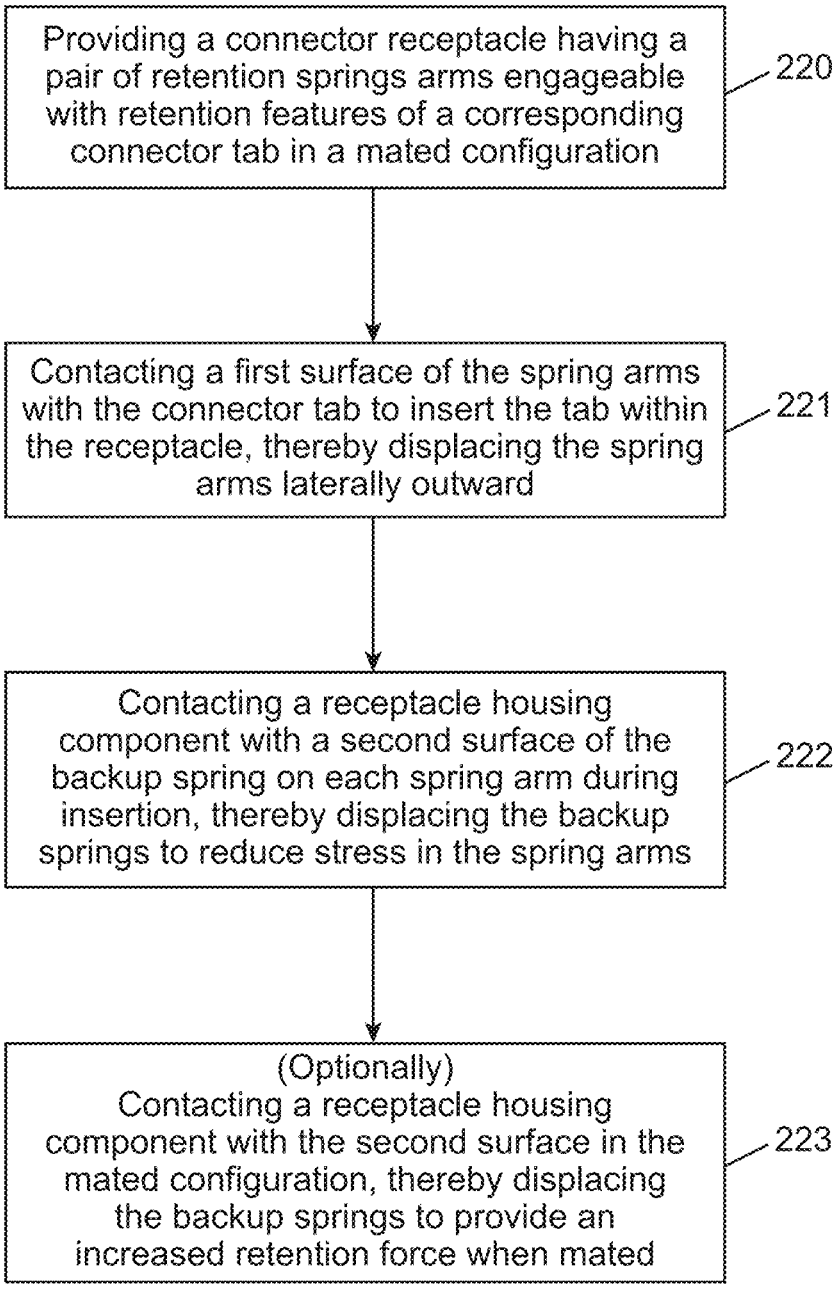
FIGS. 32-34 show methods of use of a connector device in accordance with embodiments of the invention.
Figure 33:
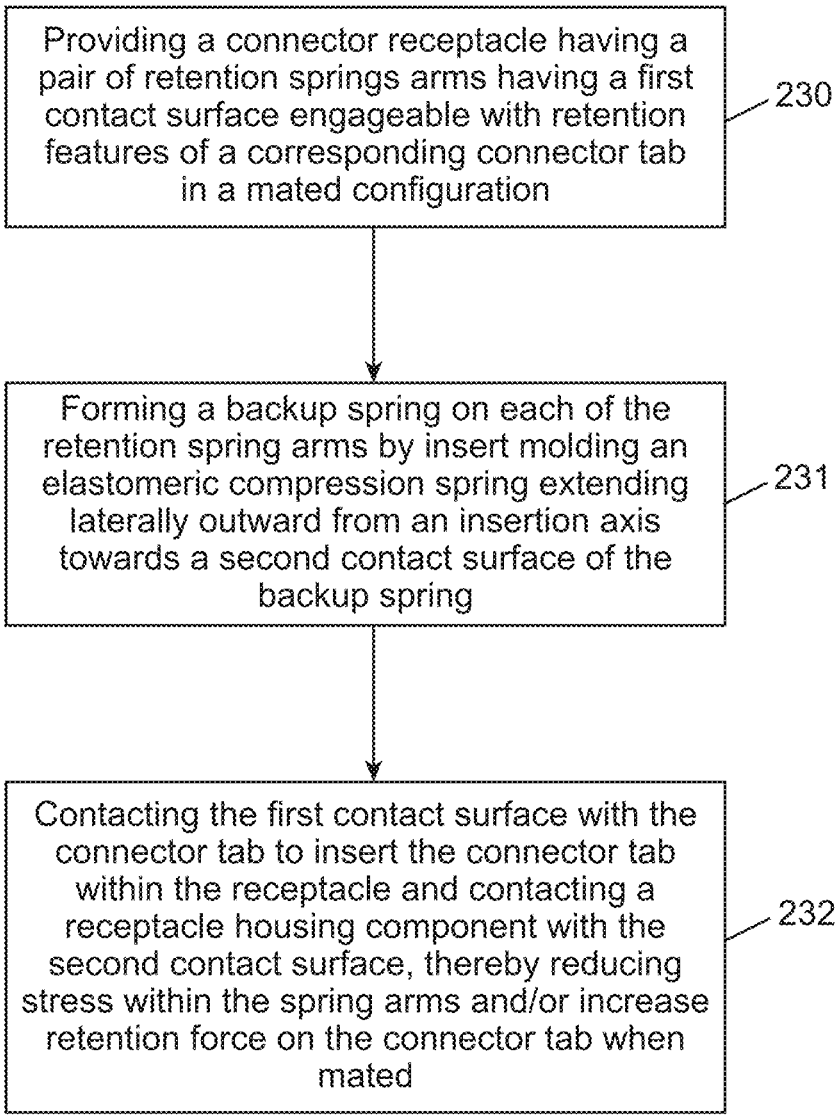
Figure 34:
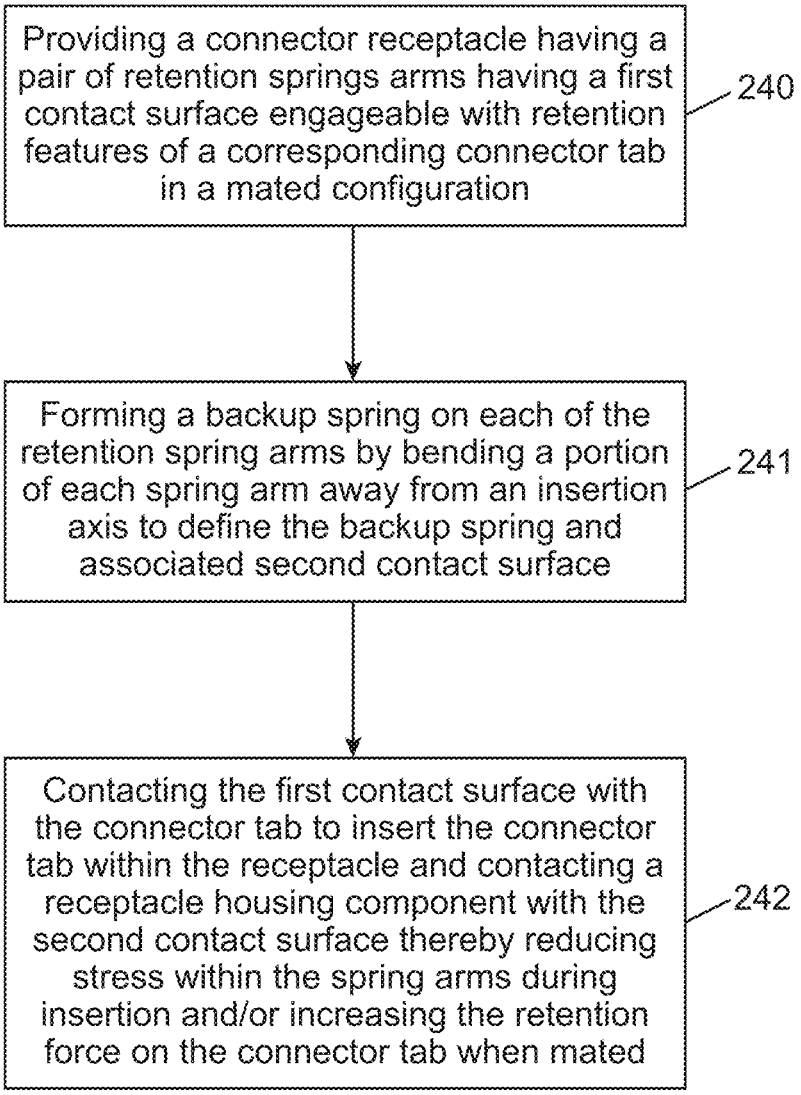

FIGS. 32-34 depict methods of use and assembly of a retention mechanism in accordance with the present invention. As shown in FIG. 32, an example method of using such a retention mechanism may include: providing a connector receptacle having a pair of retention springs arms engageable with retention features of a corresponding connector tab in a mated configuration 220; contacting a first surface of the spring arm with the connector tab to insert the tab within the receptacle, thereby displacing the spring arms laterally outward 221; contacting a receptacle housing component with a second surface of the backup spring on each spring arm during insertion, thereby displacing the backup springs to reduce stress in the spring arms 222; and optionally contacting a receptacle housing component with the second surface in the mated configuration, thereby displacing the backup springs to provide an increased retention force when mated 223.

In one aspect, as depicted in FIG. 33, the method may include: providing a connector receptacle having a pair of retention spring arms having a first contact surface engageable with retention features of a corresponding connector tab in a mated configuration 230; forming a backup spring on each of the retention spring arms by insert molding an elastomeric compression spring extending laterally outward from an insertion axis towards a second contact surface of the backup spring 231; and contacting the first contact surface with the connector tab to insert the connector tab within the receptacle and contacting a receptacle housing component with the second contact surface, thereby reducing stress within the spring arms and/or increase retention force on the connector tab when mated 232. In some embodiments, the elastomeric compression spring is formed by insert molding the spring to form an elastomeric spring having a plurality of circular disc-shaped members within an integral elastomeric component.

In another aspect, as depicted in FIG. 34, the method may include: providing a connector receptacle having a pair of retention spring arms having a first contact surface engageable with retention features of a corresponding connector tab in a mated configuration 240; forming a backup spring on each of the retention spring arms by bending a portion of each spring arm away from an insertion axis to define the backup spring and associated second contact surface 241; and contacting the first contact surface with the connector tab to insert the connector tab within the receptacle and contacting a receptacle housing component with the second contact surface thereby reducing stress within the spring arms during insertion and/or increasing the retention force on the connector tab when mated 242. The backup spring may be formed by bending a portion of the spring arm having about half a width of the spring arm into an outwardly curved C-shaped member to define the backup spring and associated second contact surface. The bent portion defining the backup spring may be formed by stamping or other metal working processes and may be formed in various different shapes and configuration having a backup spring having a spring constant extending to a second contact surface, as described herein.

The above described embodiments are intended to illustrate examples of certain applications of the invention in relation to electrical connectors, and the invention is not limited to these embodiments. It is appreciated that any of the components described in any of the embodiments may be combined and or modified in accordance with the invention. For example, an embodiment may include a combination of one or more of the various components described herein as backup springs and/or lubricating members within an electrical connector or other such application, or one or more variations and equivalents to the features described herein as would be clear given the disclosure provided herein.

What is claimed:

1. A retention latch assembly for releasably coupling a connector tab inserted into a receptacle connector of a device, the latch assembly comprising:

one or more retaining spring arms within the receptacle, each arm having a retaining portion that extends inwardly toward an insertion axis of the receptacle connector along which the connector tab is inserted into the receptacle connector so as to be resiliently received within a corresponding retention recess in a side of the connector tab when the connector tab is inserted within the receptacle connector; and one or more backup springs affixed within the receptacle and disposed adjacent a side of the one or more retaining spring arms facing away from the insertion axis such that movement of the retaining portion away from the insertion axis during insertion of the connector tab displaces the one or more backup springs to reduce the stresses within the one or more retaining spring arms during insertion of the connector tab.

2. The retention latch assembly of claim 1 wherein each spring arm comprises a resilient elongate member at least partly extending along a direction in which the connector tab is inserted so as to resiliently displace in a direction transverse to the insertion axis, and a curved portion that curves toward the insertion axis so as to facilitate sliding engagement within the corresponding retaining recess in the connector tab, wherein the retaining recess is curved.

3. The retention latch assembly of claim 1, wherein the one or more retaining spring arms comprise a pair of retaining spring arms on opposite sides of the insertion axis so that the retaining portion corresponds to two retention recesses on opposing sides of the connector tab.

4. The retention latch assembly of claim 1, wherein the receptacle comprises a receptacle housing that is coupled to an interior of the device with one or more brackets.

5. The retention latch assembly of claim 4, wherein each of the one or more backup springs comprises a portion of at least one of the one or more brackets.

6. The retention latch assembly of claim 5, wherein the backup spring comprises a tab-like portion of at least one of the one or more brackets bent upwards so as to be resiliently deflectable along the same direction as the spring arm of the receptacle.

7. The retention latch assembly of claim 1 wherein the backup spring is configured with a gap between the stress reducing member and the retaining portion of each of the one or more retaining spring arms before insertion of the connector tab into the receptacle.

8. The retention latch assembly of claim 1, wherein the one or more backup springs are attached to the one or more retaining spring arms and extend laterally outward away from the insertion axis such that outward displacement of the one or more retaining spring arms deflects the one or more backup springs.

9. The retention latch assembly of claim 8, wherein the one or more backup springs comprise compression springs.

10. The retention latch assembly of claim 9, wherein each of the compression springs comprise a plurality of elastomeric members aligned along a laterally extending axis that move toward one another when the respective compression spring is compressed.

11. The retention latch assembly of claim 8, wherein each of the one or more backup springs comprises a curved portion of the one or more retaining spring arms extending laterally outward away from the insertion axis.

12. The retention latch assembly of claim 1, wherein the one or more retaining spring arms comprises a pair of retaining spring arms and the one or more backup springs comprise bent end portions of a wire, each end portion bent along one side of the pair of retaining spring arms.

13. The retention latch assembly of claim 12, wherein the receptacle housing includes two holes through which the bend end-portions of the wire extend.

14. The retention latch assembly of claim 1, wherein the backup spring comprises a cylindrical member having an outer radius of curvature roughly corresponding to the curved portion of each of the retaining spring arm.

15. The retention latch assembly of claim 14, wherein the cylindrical member comprises an elastomeric material, the elastomeric material being compressible so as to provide a resilient stress-reducing force against the retaining spring arm when the curved retaining portion is displaced against the cylindrical member.

16. The retention latch assembly of claim 1, wherein the backup spring comprises a complementary spring arm extending along the side of the retaining spring arm facing away from the insertion axis.

17. The retention latch assembly of claim 1, wherein the backup spring comprises one or more of a bent tab-like member, an elastomeric gasket, bent end-portions of a wire, an arm-like member, a looped member, and a complementary spring arm, each coupled to a receptacle housing defining the receptacle.

18. The retention latch assembly of claim 4, wherein the one or more backup springs comprises one or more cylindrical members, each comprising an elastomeric material, and the receptacle housing comprises one or more holes for receiving the one or more cylindrical members.

19. The retention latch assembly of claim 18, wherein the one or more cylindrical members are removably positionable within the one or more corresponding holes in the receptacle housing.

20. The retention latch assembly of claim 19, further comprising:

one or more additional cylindrical member backup springs having differing spring constants, wherein the cylindrical member backup springs are interchangeable within the holes in the receptacle housing so as to allow adjustment of a retention force in the latch assembly by interchanging the cylindrical member backup springs.

21. The retention latch assembly of claim 18, wherein each of the cylindrical member comprises a head portion and a shaft, the head portion having a greater radius than the shaft such that the head portion is receivable within a countersink of the corresponding hole so as to seal the hole in the receptacle housing when positioned therein.

22. The retention latch assembly of claim 3, wherein the one or more backup springs comprise a dual backup spring having a pair of backup springs extending along the outer facing sides of the retaining spring arms.

23. The retention latch assembly of claim 22, wherein the pair of backup springs extend alongside a portion of the retaining spring arms near a base of the retaining spring arms.

24. The retention latch assembly of claim 1, wherein one or both of the retaining spring arms and the one or more backup springs comprises a lubricating member having a lubricant releasable from the member to an interface between the retention spring and the retention feature.

25. The retention latch assembly of claim 24, wherein the backup spring is the lubricating member, the lubricating member comprising a porous elastomeric material infused with the lubricant.

26. The retention latch assembly of claim 25, wherein the lubricating member comprises a reservoir in one of the first or second retention springs that releases the lubricant each time the electronic connector is mated with the second connector.

27. A receptacle connector comprising:

a receptacle housing having a front opening that extends to an interior cavity such that a corresponding connector tab can be inserted through the front opening into the interior cavity, the interior cavity having a generally rectangular shape defined by first and second opposing sides and third and fourth opposing sides;

a plurality of electrical contacts positioned within the interior cavity along the first side;

first and second retaining spring arms that extend into the interior cavity from the third and fourth opposing sides, each retaining spring arm having a retaining portion that is adapted to engage with a retention feature of a corresponding connector tab when the connector tab is mated with the receptacle connector; and first and second secondary retention mechanisms, the first secondary retention mechanism being disposed along a side of the first spring arm that faces away from the interior cavity and the second secondary retention mechanism being disposed along a side of the second spring arm that faces away from the interior cavity, wherein the first and second secondary retention mechanisms are adapted to engage with the first and second retaining spring arms when the corresponding connector tab is mated with the receptacle connector to provide a retention force on the connector tab that is greater than a retention force supplied by the first and second retaining spring arms alone.

28. The receptacle connector of claim 27 wherein the first and second retaining spring arms operate as ground contacts for the receptacle connector.

29. The receptacle connector of claim 27 wherein the first and second secondary retention mechanism are attached to the first and second retaining spring arms, respectively, each of the first and second secondary extending laterally outward away from the insertion axis.

30. The receptacle connector of claim 28 wherein the first and secondary retention mechanisms comprise any or all of a bent-tab, an L-shaped tab, an elastomeric member, and a complementary spring arm, a portion of a dual spring, or any combination thereof.

31. The receptacle connector of claim 28 wherein the first and secondary retention mechanisms each comprise an elastomeric member.

32. The receptacle connector of claim 31 wherein each elastomeric member is extendable through corresponding holes in the receptacle housing such that each elastomeric member is interchangeable with one or more additional elastomeric cylinders of differing spring constants.

33. The retention latch assembly of claim 25, wherein the one or more backup springs comprises a pair of lubricating members for placement adjacent opposing retention springs in a connector receptacle so that insertion of a connector tab into the receptacle displaces the retention springs to engage the lubricating members, wherein each of the lubricating members includes a lubricant releasable upon engagement with the retention springs during insertion of the connector tab; and further comprising:

a strip on which the pair of lubricating members are attached to facilitate positioning and/or replacement of the pair of lubricating members by positioning the strip on a receptacle housing.

34. The retention latch assembly of claim 33, wherein the strip comprises a thin plastic substrate and each of the lubricating members comprises a head and a shaft, the head being wider than the shaft, wherein the head of the lubricating member is attached to a bottom surface of the strip.

35. The retention latch assembly of claim 34, wherein each of the lubricating members comprises a porous elastomeric material infused with the lubricant so that the lubricant is released when the lubricating member is contacted by the retention spring.

36. The retention latch assembly 33, wherein the pair of lubricating members are spaced apart on the strip so as to correspond to a pair of holes on the receptacle housing such that positioning of the strip on the receptacle housing inserts the pair of lubricating members into the corresponding pair of holes into position within the receptacle.

* * * * *